US006866117B2

(12) United States Patent
Moss

(10) Patent No.: US 6,866,117 B2
(45) Date of Patent: Mar. 15, 2005

(54) LIGHT WEIGHT LADDER SYSTEMS AND METHODS

(75) Inventor: Newell Ryan Moss, Mapleton, UT (US)

(73) Assignee: Wing Enterprises, Inc., Springville, UT (US)

( * ) Notice: Subject to any disclaimer, the term of this patent is extended or adjusted under 35 U.S.C. 154(b) by 71 days.

(21) Appl. No.: 10/117,767

(22) Filed: Apr. 5, 2002

(65) Prior Publication Data

US 2003/0188923 A1 Oct. 9, 2003

(51) Int. Cl.[7] ..... E06C 1/00; E06C 7/00
(52) U.S. Cl. ..... 182/23; 182/167; 182/228.3
(58) Field of Search ..... 182/20–26, 165, 182/166, 167, 207, 208, 194, 201, 203, 228.1, 228.3

(56) References Cited

U.S. PATENT DOCUMENTS

| | | | | |
|---|---|---|---|---|
| 2,144,440 | A | 1/1939 | Gaffers | |
| 2,186,119 | A | 1/1940 | Moen | |
| 3,692,143 | A | 9/1972 | Kummerlin et al. | 182/24 |
| 4,182,431 | A | 1/1980 | Wing | 182/23 |
| 4,210,224 | A | 7/1980 | Kummerlin et al. | 182/207 |
| 4,371,055 | A | 2/1983 | Ashton et al. | 182/46 |
| 4,376,470 | A | 3/1983 | Ashton | 182/23 |
| 4,407,045 | A | 10/1983 | Boothe | 16/237 |
| 4,697,305 | A | 10/1987 | Boothe | 16/329 |
| D309,502 | S | 7/1990 | Wing et al. | D25/64 |
| 4,974,701 | A | 12/1990 | Parise | 182/194 |
| 5,002,153 | A | 3/1991 | Yuen | 182/228 |
| 5,279,387 | A | 1/1994 | Swiderski et al. | |
| 5,359,812 | A | 11/1994 | Mayfield | 49/383 |
| 5,366,051 | A | 11/1994 | Bartnicki et al. | 182/46 |
| 5,419,084 | A | 5/1995 | Sankey et al. | 49/383 |
| 5,515,942 | A | 5/1996 | Woodfield | 182/46 |
| 5,954,157 | A | 9/1999 | Grimes et al. | 182/163 |
| 5,966,777 | A | 10/1999 | Jantschek | 16/354 |
| 6,141,909 | A | 11/2000 | Hanson | 49/303 |
| 6,220,389 | B1 | 4/2001 | Krause | 182/23 |
| 6,269,909 | B1 | 8/2001 | Grimes et al. | 182/207 |
| 6,298,605 | B1 | 10/2001 | Delefosse et al. | 49/383 |
| 6,533,882 | B1 * | 3/2003 | Woodside | 156/166 |
| 2004/0140156 | A1 | 7/2004 | Moss et al. | |

FOREIGN PATENT DOCUMENTS

| | | |
|---|---|---|
| DE | 195 39 157 A1 | 4/1997 |
| EP | 0 324 885 A1 | 7/1989 |
| NL | 1002235 | 8/1997 |

OTHER PUBLICATIONS

PCT International Search Report dated Jul. 19, 2004.

* cited by examiner

*Primary Examiner*—Hugh B. Thompson, II
(74) *Attorney, Agent, or Firm*—TraskBritt

(57) ABSTRACT

A method for manufacturing a rail for a ladder. The method may include pultruding in a longitudinal direction, a rail having a selected cross-sectional shape. The rail may then be cut to a predetermined length at a distal end. A force may be applied, in a lateral direction, to the rail to form a curvature therein. The curvature may be characterized by a flared portion, a straight portion, and a curved region providing the transition therebetween. The rail may be held at the desired curvature for a time selected for the rail to take on the curvature substantially permanently. The force may then be removed and the rail may be assembled into a ladder.

14 Claims, 27 Drawing Sheets

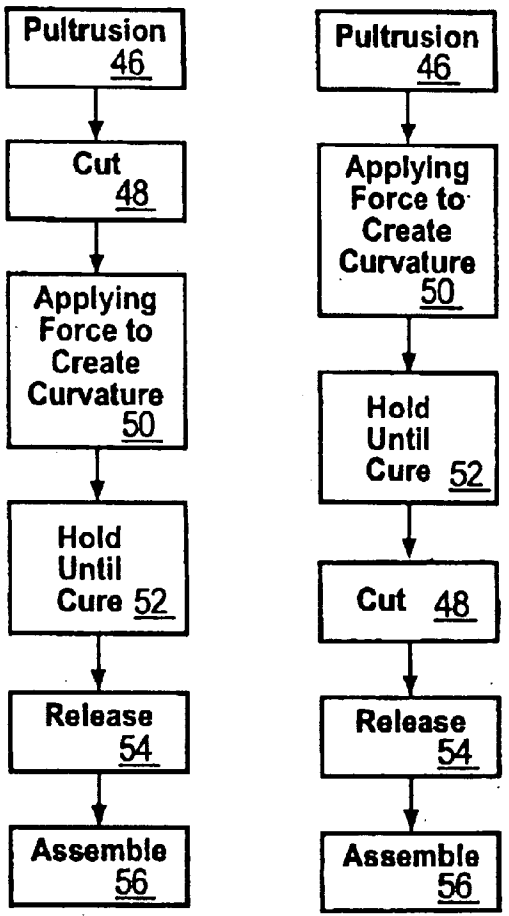
FIG. 4
FIG. 5
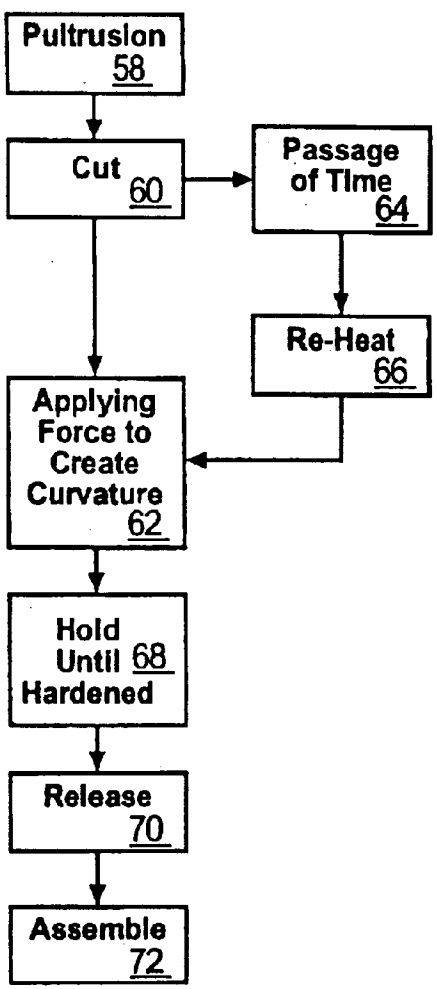
FIG. 6
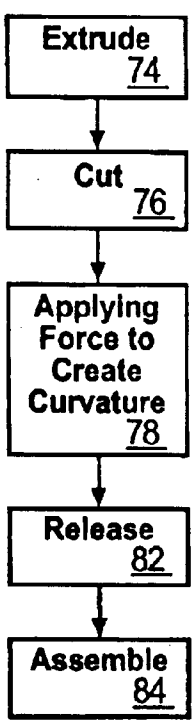
FIG. 7

LIGHT WEIGHT LADDER SYSTEMS AND METHODS

BACKGROUND

1. The Field of the Invention

This invention relates to ladders and, more particularly, to novel structures, systems, and methods for lightweight ladders.

2. The Background Art

Ladders are convenient for providing a user with access to locations that would otherwise be inaccessible. Ladders are typically available in several configurations, namely straight ladders, straight extension ladders, step ladders, and combination step and straight extension ladders ("combination ladders"). Each type of ladder may have particular situations for which it is best suited. Combination ladders are particularly useful because they provide, in a single ladder, most of the benefits of the other ladder designs. However, typical combination ladders are hampered by excessive weight, higher purchase costs, and safety concerns raised by the increased complexity of the ladder design.

In contrast to simpler ladder designs, combination ladders must support multiple load configurations. As a result, the structural elements of the ladder must be reinforced to support the loads. For example, the hinge of a combination ladder in a straight configuration must withstand larger moment loads than the hinge of a step ladder. Additionally, the hinge of a combination ladder must rigidly support the upper half of the ladder above the lower half. These load and rigidity requirements of a combination ladder hinge result in thicker components and more reinforcement material, both of which contribute to additional weight of the ladder.

Additionally, combination ladders are more expensive than traditional ladder designs. As stated above, combination ladders require additional reinforcement to compensate for the various loadings that may be applied. Stronger materials or simply additional materials increase the cost of the ladder. The greater complexity of combination ladders also increases assembly costs.

Furthermore, combination ladders present additional safety concerns. Due to the fact that combination ladders are by design collapsible, inadvertent release of the hinge may result in a total collapse of the ladder. For example, a hinge may contain a selective locking and releasing mechanism for maintaining the hinge in certain selected positions. A worker, through inadvertence or mistake, or even through stumbling or other physical imbalance, may, in some circumstances, strike a release mechanism, endangering the rigidity of the locking mechanism holding a hinge in a specific position. Typical combination ladders do not provide a remedy for such potential hazards.

Accordingly, what is needed is a combination ladder with components designed and arranged to provide the maximum strength without significantly increasing the over all weight of the ladder. Additionally, ladder components need to be designed to promote ease of manufacture and assembly, thus reducing the cost of the combination ladder. Moreover, what is needed is additional safety features such as an interlock that requires affirmative, intentional actions on behalf of a user, before a release mechanism actuates. It would be an advance in the art if the interlock and the release mechanism could both be operated by a single hand of a single user, simultaneously, but only intentionally.

BRIEF SUMMARY AND OBJECTS OF THE INVENTION

In view of the foregoing, the present invention provides ladder componentry that maintains required strength while decreasing weight, is simplified to reduce manufacturing and assembly cost, and reduces the likelihood of potential hazards.

For certain applications, it may be desirable to widen the stance of the ladder rails (side rails) to increase stability of the ladder on the supporting surface. This may be accomplished by creating an outward flare in the rails, tapering above the supporting surface. The present invention may provide a method for manufacturing such a rail. The method may include pultruding in a longitudinal direction, a rail having a cross-sectional shape. The rail may then be cut to a predetermined length to receive rungs.

Before the rail material has cured or hardened, a force may be applied, in a lateral direction, to the rail to form a curvature therein. The curvature may be characterized by a flared portion, a straight portion, and a curved region providing the transition therebetween. The curved region may have a shape selected from a continuous arc substantially coincident with the flared portion, a series of angled bends spaced from one another along the curved region, and a single continuous bend connecting a straight portion to a flared portion.

The force may be maintained, holding the rail at the curvature, for a time selected for the rail to take on the curvature substantially permanently. The rail may then be assembled into a ladder. The rungs applied to the ladder may have a length selected to accommodate the flare.

Rails in accordance with the present invention may have any suitable cross-section. The cross-section may be selected for structural rigidity, strength, stiffness, ergonomics, ease of manufacturing, or some balance of other competing considerations. Rails may be formed with an open or closed cross-section. In certain selected embodiments, an extension ladder may comprise an open-cross-section exterior rail with a closed-cross-section interior rail sliding longitudinally within a portion thereof. If desired, glide pads or strips may be included at the interface between exterior and interior rails to decrease friction and wear during motion therebetween.

Rails and rungs in accordance with the present invention may be constructed of any suitable material. In certain embodiments, rails may be formed of a reinforcing fiber in a thermoset polymer matrix. A fiber reinforced thermoplastic polymer, metal, or metal alloy may also be used as the rail or rung material. The choice of material may influence the manufacturing process. For example, if aluminum were selected for the rail material, an extrusion process may be selected instead of a pultrusion process. If desired, portions or all of the interior of the rail or rung cross-sections may be filled with a filler material to increase structural performance such as resistance to buckling.

The present invention may provide a method for manufacturing a rung. The method may include monolithically forming a tube of a selected material. The tube may have a body portion comprising a closed cross-section with at least one substantially flat side wall. A first rib may extend in a first direction away from the body portion so as to be substantially co-planar with the flat side wall. If desired, a second rib may extend in a second direction away from the body portion so as to also be substantially co-planar with the flat side wall. The tube may be extruded, then cut to a desired length.

Depending on the application for which the rung is designed, ribs may be used for different purposes. For example, if the rung is to be used between interior rails, the ribs may form the tread surface. If the rung is to be used between exterior rails, the ribs may be used as securement locations for securing the rung to the rails. In such a case, portions of the ribs may be removed to expose the body portion for a tread surface.

The present invention may include various reinforcing methods and structures. These may maintain a required strength locally while permitting thinner wall thickness elsewhere, and thus reducing the weight of the ladder. For example, a collar may support the walls of a rail against crushing when swaging a rung thereto. In certain embodiments, a reinforcing plate may support the side wall of a rail against splitting forces under the load imposed thereon by an extension lock.

A hinge in accordance with the present invention may include a first armature pivotably connected to a second armature. A lock may connect to the first armature to be movable between a first, locked position fixing the first armature with respect to the second armature, and a second, unlocked position providing uninhibited pivoting of the armatures. If desired, additional locking positions may be added. Such locking positions may include a closed position, a step ladder position, and a straight position.

A pinch point may result when the end faces of corresponding armatures come in contact with one another. If a hand, finger, or the like of a user were to be caught in a pinch point, serious injury may result. Various hinge guards and armature designs and configurations may be applied to a hinge in accordance with the present invention in an effort to protect the user from being pinched.

Guards in accordance with the present invention may produce a barrier for preventing any part of a user from entering the pinch point, thus preventing injury. Additionally, the armature of a hinge may be shaped to provide spacing when in the straight position, thus greatly reducing the size of the pinch point, or in some embodiments, eliminating the pinch point entirely.

In certain embodiments, an interlock comprising an actuator may selectively resist the movement of the lock from a locked position to an unlocked position. The interlock may resist movement of the lock in any suitable manner. In selected embodiments, the interlock may pivot in and out of an interference position with respect to the lock, thus controlling the release of the lock.

The interlock may include a bias member to urge the interlock into the lock-secured (non-releasable) position. The lock and the interlock may be movable and positioned to be simultaneously actuated by a single hand of a user.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 4 is a block diagram illustrating one method of forming ladder rails of a fiber reinforced (e.g. thermoset) polymer in accordance with the present invention;

FIG. 5 is a block diagram illustrating an alternative method of forming ladder rails of a fiber reinforced (e.g. thermoset) polymer in accordance with the present invention;

FIG. 6 is a block diagram illustrating one method of forming ladder rails of a fiber reinforced (e.g. thermoplastic) polymer in accordance with the present invention;

FIG. 7 is a block diagram illustrating one method of forming ladder rails of a metal in accordance with the present invention;

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following more detailed description of the embodiments of the systems and methods of the present invention, as represented in FIGS. 1 through 48, is not intended to limit the scope of the invention, as claimed, but is merely representative of certain exemplary embodiments in accordance with the invention. The various preferred embodiments of the invention will be best understood by reference to the drawings, wherein like parts are designated by like numerals throughout.

Figure 1:
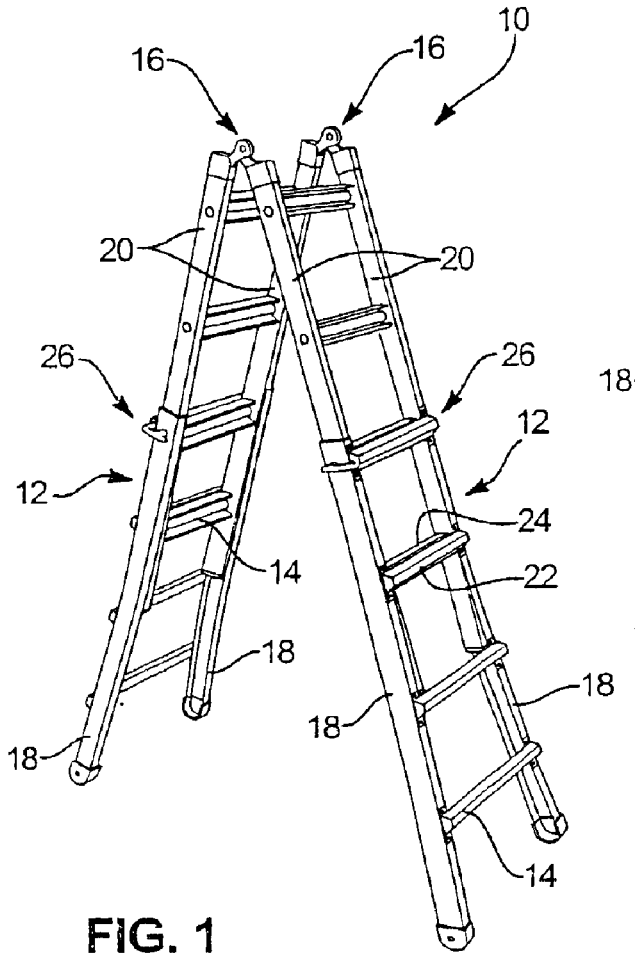
FIG. 1 is a perspective view of a combination type extension ladder in accordance with the present invention in a step ladder configuration.
Figure 2:
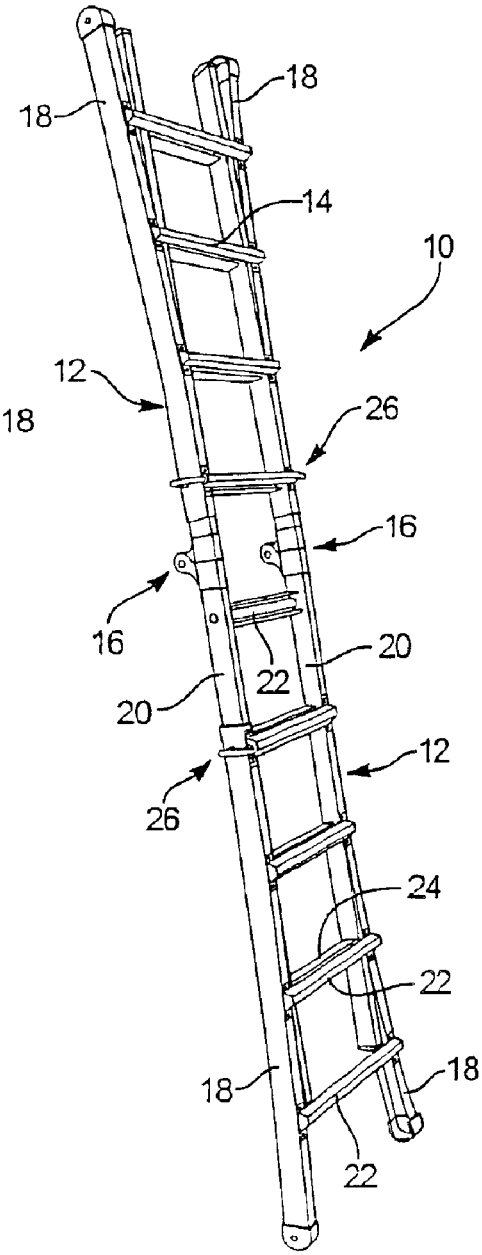
FIG. 2 is a perspective view of an extension ladder in accordance with the present invention in a straight, locked-out configuration.

Referring to FIGS. 1 and 2, ladders 10 typically comprise three main component groups, namely the rails 12 providing the vertical support, the rungs 14 providing the steps, and the hinges 16 providing pivoting of the rails 12 between open and closed positions. Step ladders 10 or combination ladders 10 may have components selected to meet the needs of the particular ladder design.

For example, while a step ladder 10 only requires a rung 14 with a single tread, a combination ladder 10 may require rungs 14 that provide a tread on two sides. Extension ladders 10 require rails 12 capable of extending or contracting in length. In one embodiment, an exterior rail 18 may house or engage an interior rail 20 in a telescoping relation to provide a ladder 10 of variable height.

Extension ladders 10 may have different rung 14 designs to accommodate extension of rails 12. For example, exterior rungs 22 may be mounted on the outside of the exterior rails 18 to avoid interfering with the sliding motion of the interior rails 20. Interior rungs 24 may extend between interior rails 20. An extension lock 26 may provide a stop to releasably lock the exterior rails 18 with respect to the interior rails 20 at periodic locations of extension.

The intended use of a ladder 10 greatly affects the design of the hinges 16. The hinges 16 used to lock a ladder 10 in a straight configuration must typically support much larger loads than the hinges 16 of a simple step ladder 10. Moreover, the rigidity of a hinge 16 used in a straight configuration must be greater to securely and safely maintain the upper half of the ladder 10 above the lower half of the ladder 10.

In the disclosure presented herein, each ladder 10 component group (i. e. rail 12, rung 14, hinge 16), with illustrative alternative embodiments, will be addressed separately and in order. It should be understood that most of the designs of component 12, 14, 16 are compatible with one another and even interchangeable in many cases. Thus, for example, if a number of designs of rungs 14 are presented, the intended use of the ladder 10 may determine which rung 14 may be the most appropriate for the particular application.

Figure 3:
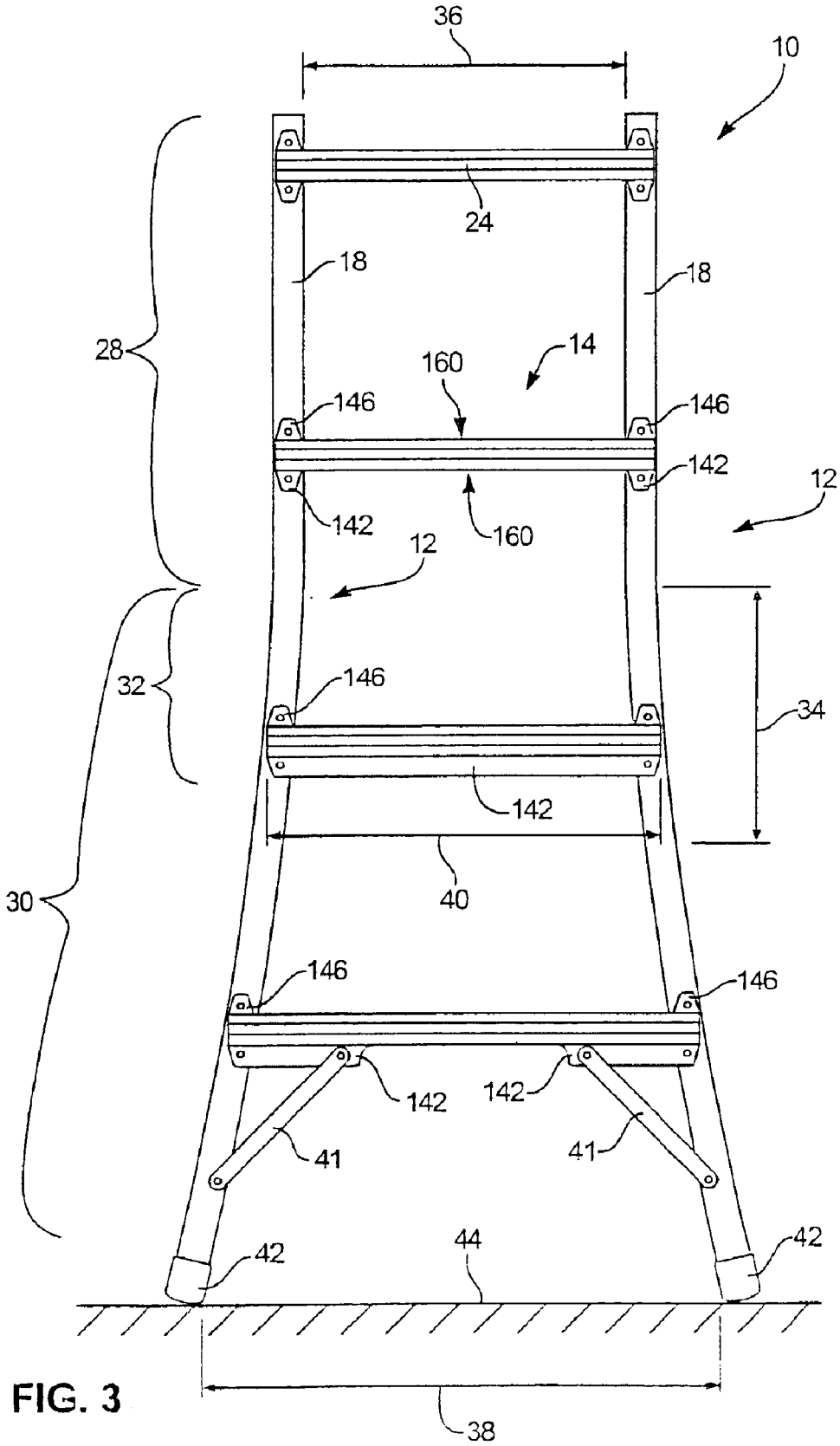
FIG. 3 is a front elevation view of pair of flared exterior rails connected by several exterior rungs of varying configurations in accordance with the present invention.

Referring to FIG. 3, the rails 12 of a ladder 10 provide the vertical support for the user and the rest of the ladder 10 structure. Rails 12 may be constructed of any suitable material including metal, metal alloy, composite, reinforced polymer, wood, and the like. Commonly used materials may include aluminum alloys and fiber reinforced thermoset and thermoplastic polymers. The purpose for which the ladder 10 will be used may provide the information necessary to determine which rail 12 material may be best suited for the job. For example, a ladder 10 used by an electrician may have rails 12 made of a non-conducting material, thus reducing the risk of grounding the user through the ladder 10 and producing an electric shock.

In other ladder 10 applications, cost may be the driving factor when determining the best rail 12 material. The rail 12 configurations and manufacturing methods presented herein may be applied to rails 12 constructed of many suitable materials.

Exterior rails 18 may be shaped to improve the performance of the ladder 10 into which they are integrated. In certain embodiments, an exterior rail 18 may be divided into a straight portion 28 and a flared portion 30. The transition from the straight portion 28 to the flared portion 30 may be accomplished by a curved region 32. A length 34 of the curved region 32 may be of any suitable magnitude. For example, the length 34 of the curved region 32 may be comparatively short and simply provide the transition from the straight portion 28 to the flared portion 30. In an alternative embodiment, the length 34 of the curved region 32 may be greater and make up a large part of the flared portion 30. In such a case, the curved region 32 is increasing the flare throughout the flared portion 30.

When assembled into a ladder 10, the straight portions 28 of corresponding exterior rails 18 may be separated by a distance 36 corresponding to the width of a normal ladder 10. The flared portions 30 of corresponding exterior rails 18 may begin with the same distance 36 of separation and then widen to produce a wider base stance 38. The wide base stance 38 may improve overall stability of the ladder 10.

The particular curved region 32 or flared portion 30 of an exterior rail 18 may be selected to improve stability of the ladder 10. The curved region 32 may create any suitable curvature or flare in the flared portion 30. For example, the curved region 32 may be a continuous arc substantially coincident with the flared portion 30. In an alternative embodiment, the curved region 32 may be produced by a series of angled bends spaced from one another along the flared portion 30. Additionally, the curved region 32 may be produced by a single continuous bend connecting the straight portion 28 and the flared portion 30 of the exterior rail 18.

The exterior rails 18 may provide a location for the securement of the exterior rungs 22. The length 40 of the exterior rungs 22 may be selected to fit the particular curvature of the exterior rails 18. Several exterior rung 22 configurations are illustrated. These rung 14 embodiments will be presented hereinafter. Triangulation braces 41 are also illustrated. Triangulation braces 41 may be secured from the rails 12 to the rungs 14 to provide additional support and structural rigidity. Additionally, feet 42 may be applied to the lower extreme of selected rails 12. The feet 42 may efficiently transfer the load from the rails 12 to a supporting surface 44. The feet 42 may also resist slipping of the ladder 10 with respect to the supporting surface 44, thus increasing safety.

Referring to FIG. 4, various methods may be used to shape a rail 12. The rail 12 material may influence the choice of what shaping process may be most suitable. For example, with a fiber reinforced thermoset polymer, a pultrusion followed by a shaping process may be ideal. Such a process may include pultruding 46, in a longitudinal direction, a rail 12 having a selected cross-sectional shape. The rail 12 may then be cut 48 to a pre-determined length at a distal end. While the pultruded rail 12 is yet uncured, a force may be applied 50 to the rail 12 in a lateral direction to form a selected curvature therein. The curvature may be characterized by a straight portion 28, a flared portion 30, and a curved region 32 providing the transition therebetween.

The applied force 50 may be held 52 or maintained 52 for a time selected for the thermoset material to fully cure and maintain the curvature substantially permanently. Once the desired curvature of the rail 12 is permanently fixed, the rail 12 may then be released 54 and assembled 56 into a ladder 10.

Referring to FIG. 5, in an alternative embodiment, the pultrusion 46 of the rail 12 may be followed by applying a force 50 to the yet uncured rail 12 to generate a curvature therein. Once the rail 12 is held 52 at the desired curvature, it may be cut 48 to a proper length. Thus, the application of the force 50 and the cutting process 48 may be interchanged in the order in which they occur. Once the rail 12 has been held 52 or maintained 52 for a time period selected for the thermoset material to fully cure and maintain the curvature substantially permanently, the rail 12 may be released 54 and assembled 56 into a ladder 10.

Referring to FIG. 6, in certain embodiments, fiber reinforced thermoplastic polymers may be used as the material for the rails 12. In such a case, the rail 12 may be pultruded 58, in a longitudinal direction, to have a selected cross-sectional shape. The rail 12 may then be cut 60 to a pre-determined length at a distal end. As mentioned hereinabove in conjunction with other embodiments, the particular order in which the cutting process 60 occurs in relation to the other steps may vary.

However, assuming that the cutting process 60 occurs immediately after the pultrusion 58, the rail 12 may then follow one of two different paths. While the pultruded rail 12 is yet unhardened, a force may be applied 62 to the rail 12 in a lateral direction to form a selected curvature therein. Alternately, with the passage of time 64, the rail 12 may be allowed to harden in its pultruded state. Then, when convenient, the rail 12 may be reheated 66 to near the glass transition temperature of the thermoplastic polymer.

While in this unhardened state, the force may then be applied 62 to the rail 12 in a lateral direction to form the selected curvature therein. The thermal and mechanical properties of thermoplastic polymers make this reheating and reshaping possible. Once the rail 12 has been held 68 or maintained 68 for a time period selected for the thermoplastic material to fully harden and maintain the curvature, the rail 12 may be released 70 and assembled 72 into a ladder 10.

Referring to FIG. 7, when a metal or a metal alloy is selected as the material for the rail 12, different processes may be employed. For example, a rail 12 may be extruded 74, in a longitudinal direction, with a desired cross-sectional shape. The rail 12 may then be cut 76 to a desired length. The shape of the rail 12 may be controlled by applying a force 78 in a lateral direction to form a curvature therein. The force may be maintained until the rail 12 fully cools and permanently takes on the desired curvature.

In other embodiments, if the rail 12 has fully cooled by the time it is to be shaped, the shaping process may simply be a cold bending of the metal. In such a case, overcompensation in the application of the force 78 may be necessary to produce the desired curvature. That is, the rail 12 may need to be bent more than the desired curvature so when the force is released 82, and the rail 12 springs back slightly, the resting position is actually the desired curvature. Once the rail 12 has been released 82, it may be assembled 84 into a ladder 10.

Figure 8:
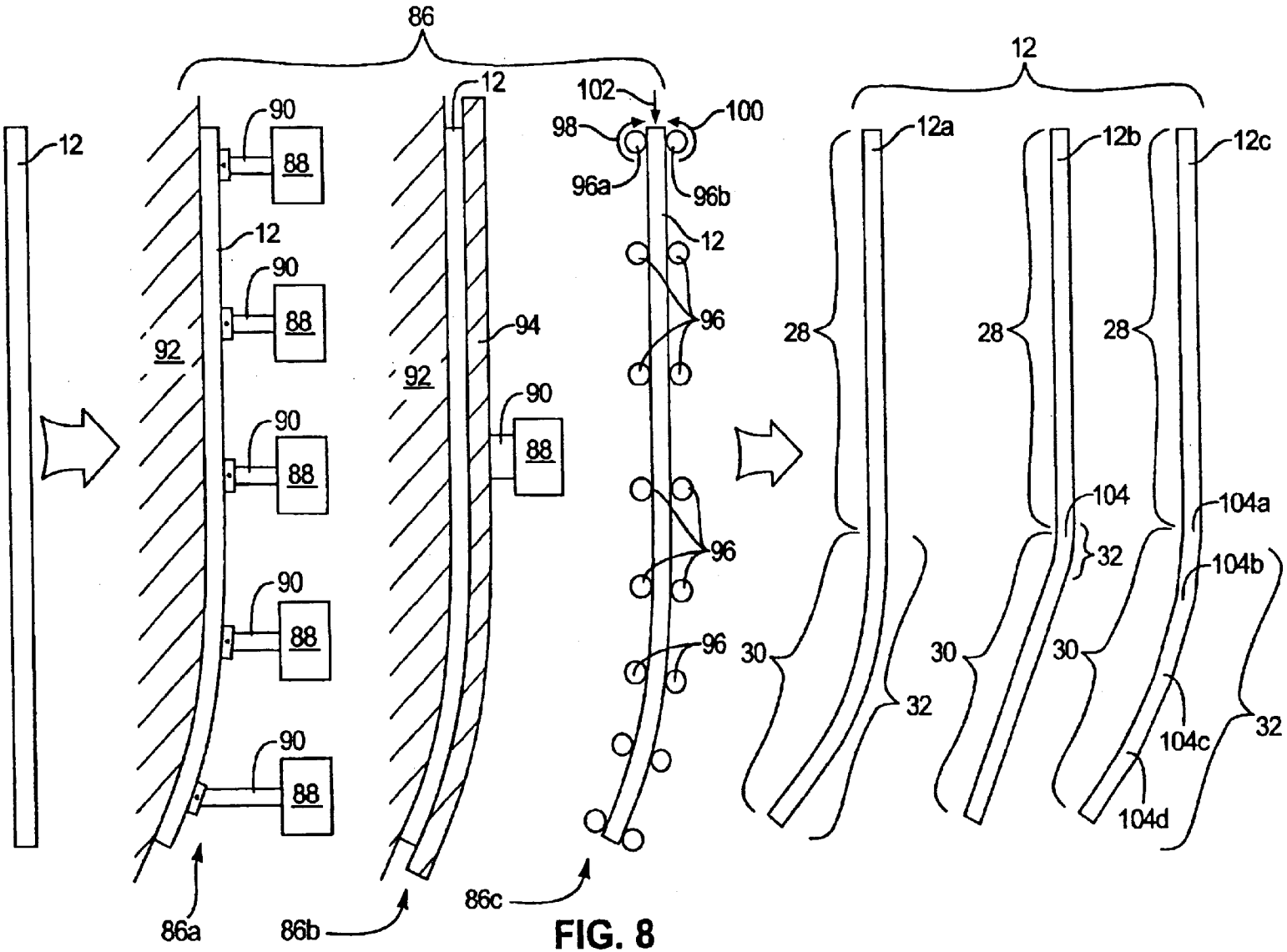
FIG. 8 is an illustration of several shaping processes for ladder rails in accordance with the present invention.
Figure 9:
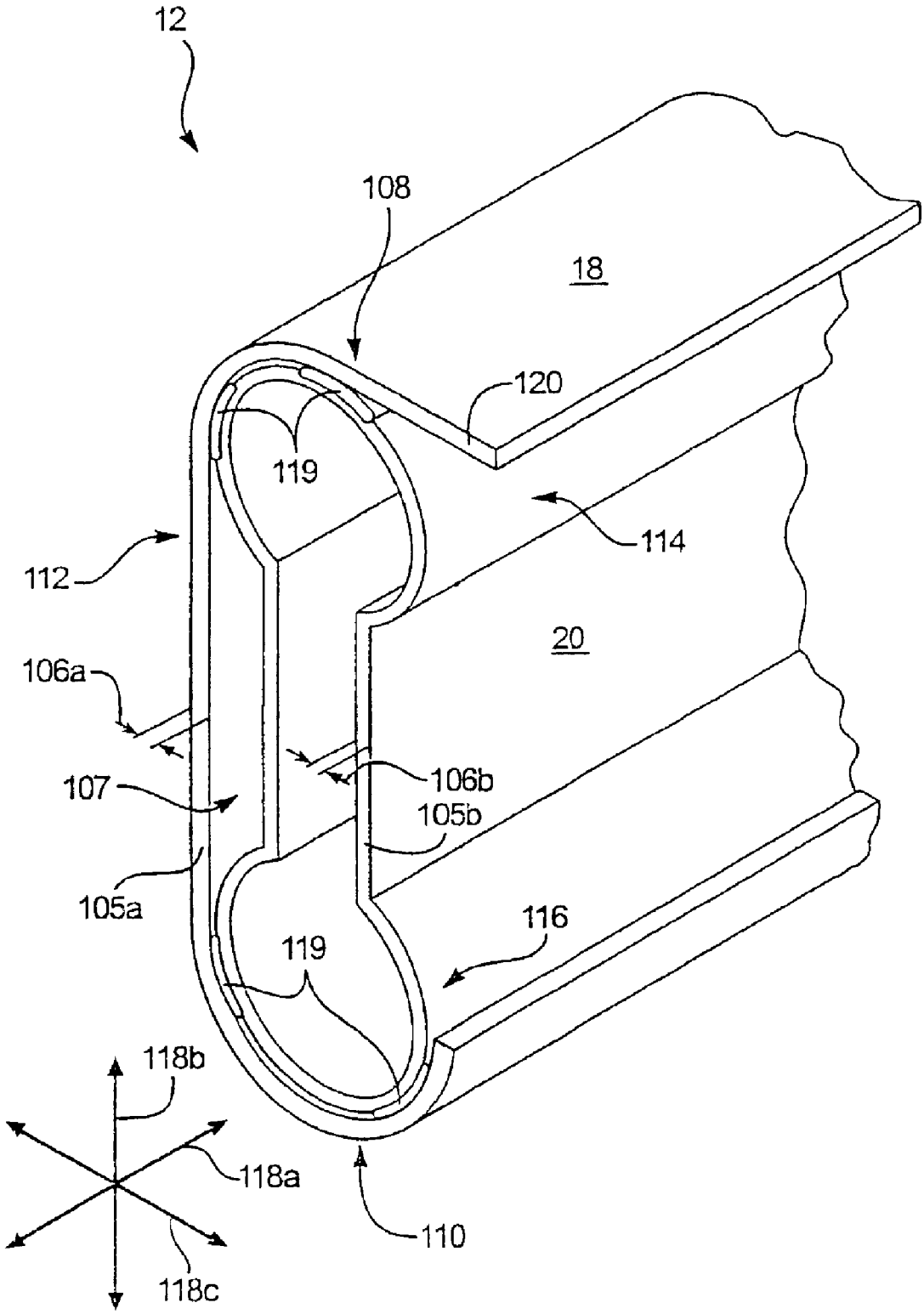
FIG. 9 is a perspective, cross-sectional view of an interior rail and exterior rail combination with glide pads, all in accordance with the present invention.
Figure 10:
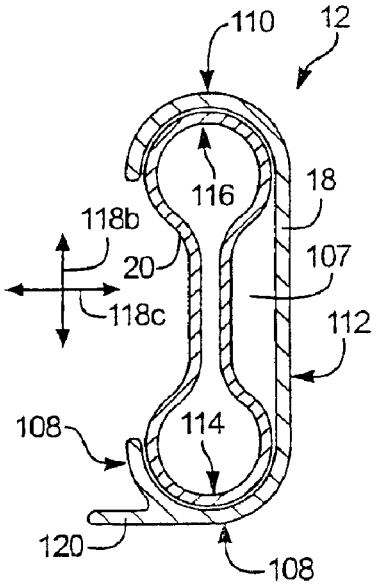
FIG. 10 is a cross-sectional view of an interior rail and exterior rail combination in accordance with the present invention.
Figure 11:
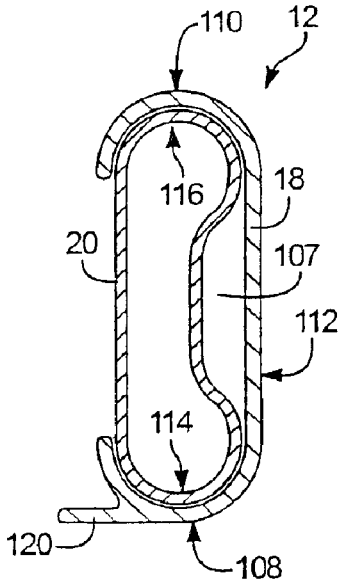
FIG. 11 is a cross-sectional view of an alternative combination of an interior rail and exterior rail in accordance with the present invention.

Referring to FIG. 8, rails 12 in accordance with the present invention may be shaped by any suitable force applicator 86. In certain embodiments, a force applicator 86*a* may have multiple actuators 88 for extending and retracting arms 90. Once a rail 12 is formed and while it is still in an uncured, unhardened, or unbent state, a lateral force may be applied to the rail 12 by the actuators 88 extending arms 90 thereagainst to force the rail 12 against a mandrel 92. The mandrel 92 may have the desired curvature already formed therein. Thus, when the rail 12 is forced against the mandrel 92, it may conform to the curvature of the mandrel 92.

In an alternative embodiment, a rail 12 may be shaped between a movable mandrel 94 and a rigid mandrel 92. In such an embodiment, a rail 12 in an uncured, unhardened, or unbent state may be sandwiched between the movable mandrel 94 and the rigid mandrel 92. An actuator 88 may manipulate an extending and retracting arm 90 to provide the impetus for forcing the movable mandrel 94 against the rigid mandrel 92.

In another embodiment a rail 12 may be shaped by a series of roller pairs 96. A roller pair 96 may consist of a first roller 96*a* selectively rotated in a first direction 98 and one or more second rollers 96*b* selectively rotatable in a second direction 100. When actuated, the rollers 96*a*, 96*b* rotate in a manner to pull the rail 12 along in a desired direction 102. The roller pairs 96 may generate the curvature in the rail 12 by any suitable manner. In one embodiment, the roller pairs 96 may be spaced and positioned so that as a rail 12 is pulled between each successive roller pair 96, it may be slightly redirected. Thus, when the rail 12 reaches the last roller pair 96 and rotation is stopped, the rail 12 is being held in the desired curvature. In an alternative embodiment, the roller pairs 96 may be linearly aligned as the rail 12 is received. Once the rail 12 reaches the last roller pair and stops, the roller pairs 96 may be repositioned, thus, forming the curvature in the rail 12. Suitable retainers may hold the rails from distorting in other directions.

As mentioned hereinabove, the curvature of the rail 12 may have many different configurations. As stated, a rail 12*a* may comprise a curved region 32 having continuous arc substantially coincident (tangent) between the straight portion 28 and the flared portion 30. In such an embodiment, the curved region 32 extends substantially throughout the flared portion 30.

In other embodiments, the curved region 32 of rail 12*b* may consist of a relatively short, single, continuous bend 104 connecting the straight portion 28 to the flared portion 30. Additionally, the curved region 32, as shown on rail 12*c*, may consist of a series of small bends 104*a*, 104*b*, 104*c*, 104*d* periodically dispersed throughout the flared portion 30. Each forming method and resulting curvature may have certain benefits and disadvantages. For example, a series of slight bends 104*a*, 104*b*, 104*c*, 104*d* does not produce a stressed region or weakened region as large as that produced by a single, more dramatic bend 104. This may be particularly true when the rail 12 is formed by bending an already hard material such as a metal.

Referring to FIGS. 9–15, the cross-sectional shapes of the exterior rails 18 and interior rails 20 may be selected to provide a desired strength, durability, rigidity, or some combination thereof. Naturally, cross-sections of greater rigidity allow for walls 105*a*, 105*b* (see FIG. 9) of lesser thickness 106*a*, 106*b*, providing a more lightweight construction. The cross-sectional shapes embodied in FIGS. 9–15 are illustrative only. Various cross-sectional shapes may be suitable. Other suitable cross-sections may be generally circular, elliptical, triangular, rectangular, or the like.

The particular cross-sectional shape selected may promote proper clearances between moving parts. For example, as will be discussed in more detail, an interior rung 24 may secure to an interior rail 20 by extending therethrough. Clearance 107 may exist on the far side of the interior rail 20 to accommodate the interior rung 24 securement.

In certain embodiments, the exterior rails 18 may be formed with an open cross-section. The open cross-section allows the exterior rails 18 to contain the interior rails 20 while still providing access for an interior rung 24 to secure to the interior rail 20. The open cross-section of an exterior rail 18 may have a first retainer 108 and second retainer 110 connected by a web 112. The first retainer 108 may engage or surround a first side 114 of an interior rail 20. The second retainer 110 may engage or surround a second side 116 of the interior rail 20. The web 112 may maintain the first and second retainers 108, 110 in a substantially fixed relation to each other, thus containing the interior rail 20 within the exterior rail 18 to prevent motion therebetween in a lateral direction 118*b*.

In certain embodiments, the retainers 108, 110 of an exterior rail 18 may extend sufficiently around the sides 114, 116 of an interior rail 20 to prevent motion therebetween in both a lateral direction 118*b* and a transverse direction 118*c*. As a result, the interior rail 20 may only move in a longitudinal direction 118*a* with respect to the exterior rail 18.

In selected embodiments, it may be advantageous to incorporate glide strips 119 at the interface between certain exterior rail 18 and interior rail 20 surfaces. Glide strips 119 may be secured to either the exterior or the interior rail 18, 20. The glide strips 119 may be positioned to reduce the frictional forces resulting from the rails 18, 20 sliding in a longitudinal direction 118*a* with respect to each other.

The glide strips 119 may be constructed of any suitable friction-reducing material. In certain embodiments, the glide strips 119 are constructed of vinyl, Teflon®, high density polyethylene, or the like. The glide strips 119 may be integrally formed with the rail 12 or they may be applied with an adhesive or other fastening device during the assembly of the ladder 10.

In other embodiments, instead of or in addition to surrounding the first side 114 of an interior rail 20, a first retainer 108 may extend outward in the transverse direction 118*c* to form a rib 120 along the length of the exterior rail 18. This rib 120 may provide a location for an exterior rung 22 to secure to an exterior rail 18 without interfering with the motion of an interior rail 20.

Figure 12:
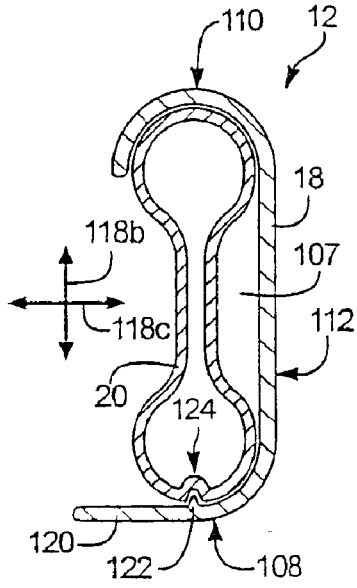
FIG. 12 is a cross-sectional view of an alternative combination of an interior rail and exterior rail in accordance with the present invention.

Referring specifically to FIG. 12, a retainer 108, 110 need not surround a side 114, 116 in order to resist motion between an exterior rail 18 and an interior rail 20 in a transverse direction 118*c*. In selected embodiments, a retainer 108 may have a ridge 122 formed therein. A corresponding valley 124 may be formed in a side 114 of an interior rail 20. Thus, when assembled, the ridge 122 and valley 124 engage and resist transverse motion of the exterior rail 18 with respect to the interior rail 20.

Figure 13:
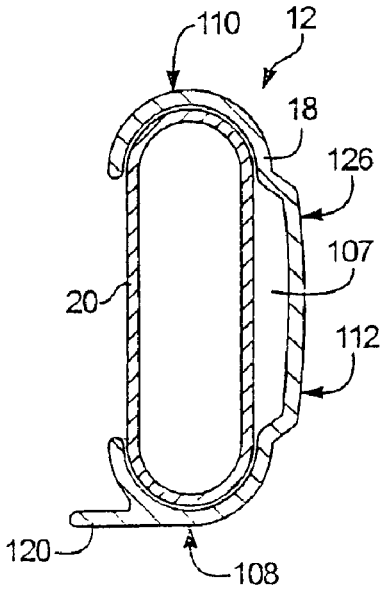
FIG. 13 is a cross-sectional view of an alternative combination of an interior rail and exterior rail in accordance with the present invention.

Referring specifically to FIG. 13, and in view of the embodiments of FIGS. 9–12, the clearance 107 for an interior rung 24 securement is incorporated as part of the interior rail 20 cross-sectional shape. However, the clearance 107 may also be incorporated as part of the cross-section of an exterior rail 18. Specifically, the web 112 may have a contour 126 to provide the clearance 107. In applications where no clearance 107 is needed, it may still be advantageous to form contours 126 in the web 112. Such contours 126 may increase the rigidity (e.g. section modulus) of the exterior rail 18.

Figure 14:
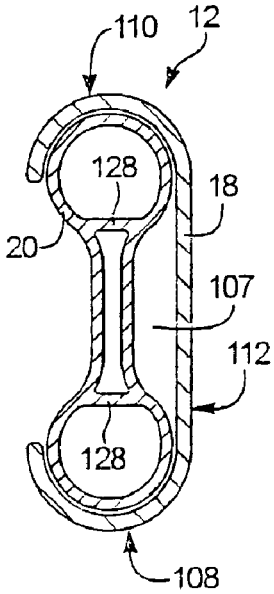
FIG. 14 is a cross-sectional view of an alternative combination of an interior rail and exterior rail in accordance with the present invention.

Referring specifically to FIG. 14, the cross-section of an interior rail 20 may have internal webs 128 to increase the strength, rigidity, and the like. The number, positioning, and thickness of the internal webs 128 may be selected to provide optimum performance while minimally increasing the weight of the interior rail 20.

Figure 15:
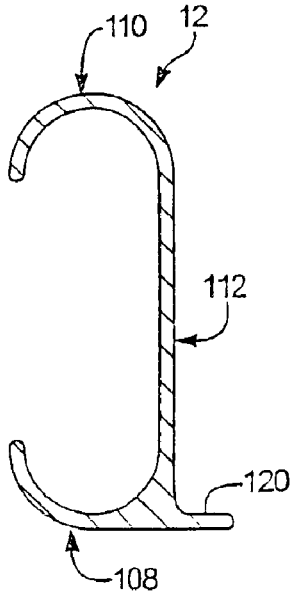
FIG. 15 is a cross-sectional view of an alternative exterior rail embodiment in accordance with the present invention.

Referring specifically to FIG. 15, a rib 120 may provide a location for an exterior rung 22 to secure to an exterior rail 18 without interfering with the motion of an interior rail 20. Such a rib 120 may extend in a transverse direction 118*c* toward the inside of the ladder 10 (see FIGS. 9–14). Additionally, the rib 120 may extend in a transverse direction 118*c* toward the outside of the ladder 10.

Figure 16:
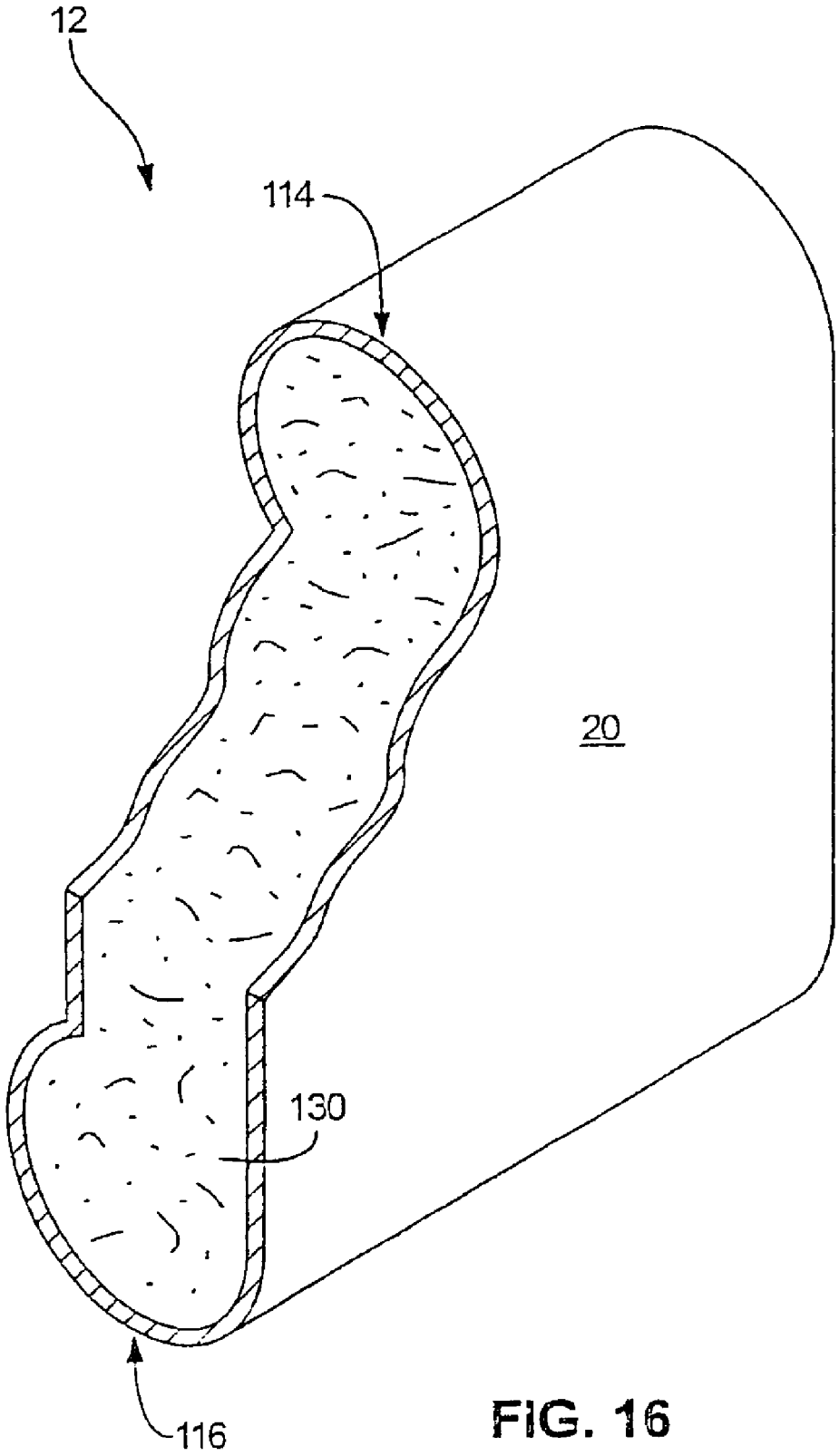
FIG. 16 is a cut-away, perspective view of a foam-filled interior ladder rail in accordance with the present invention.
Figure 17:
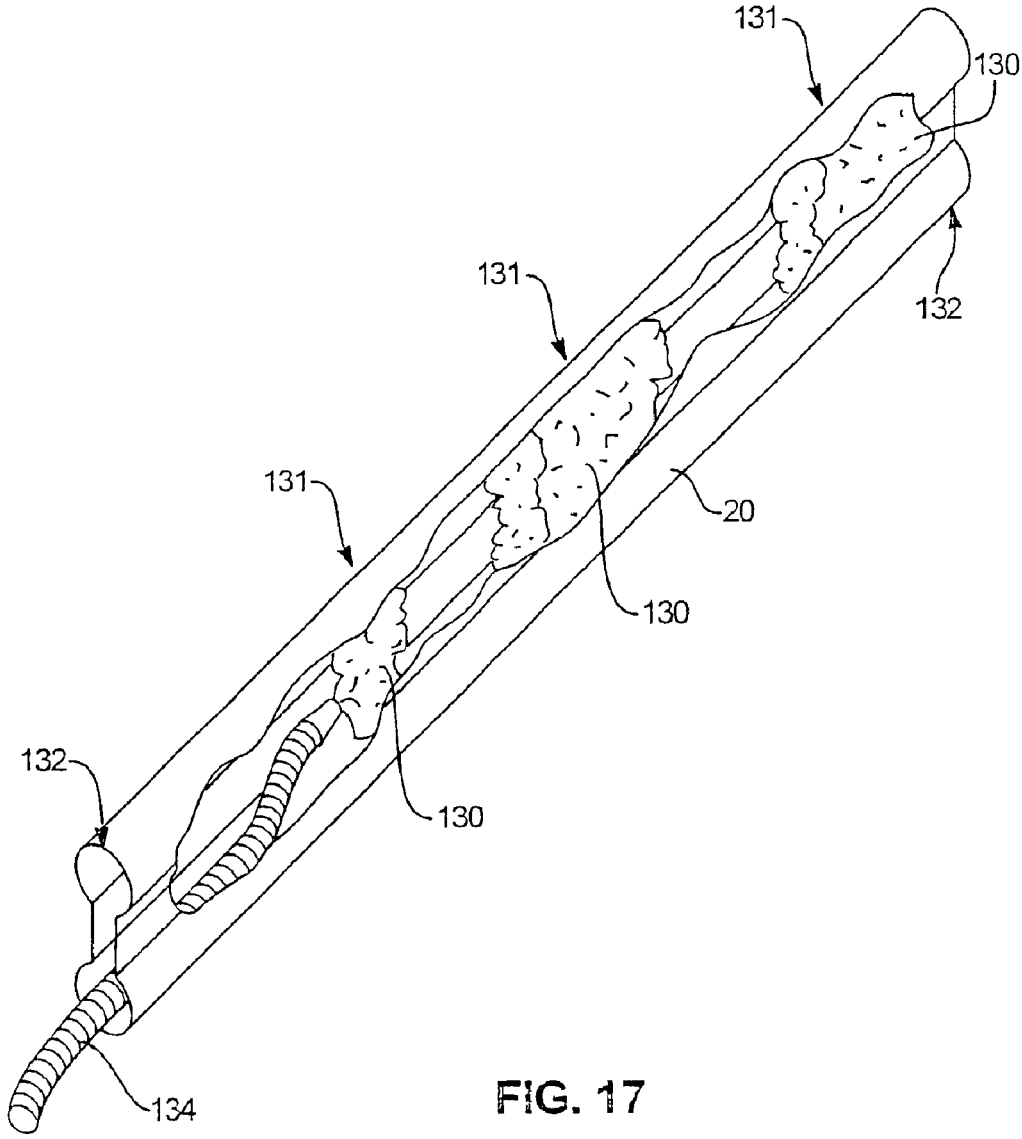
FIG. 17 is a cut-away, perspective view of a method for periodically filling an interior rail with foam in accordance with the present invention.

Referring to FIGS. 16 and 17, either all or a portion of the interior rails 20 and either all or a portion of each exterior rail 18 may be filled with a lightweight material 130 to increase torsional rigidity and strength. The filling material 130 may be any material having the desired installation procedures, weight, and compression resistance. The filling material 130 may be sprayed, poured, or otherwise inserted inside the rail 12. Once inserted, the filler 130 may expand and fill the interior of the rail 12. In other embodiments, the filler 130 may occupy the interior of the rail 12 and only require a curing or drying time to achieve proper hardness. In certain embodiments, the filling material 130 may be an expanded polystyrene or other polymer.

Filling reinforcement may be advantageous because, with minimal increase in weight, the strength of rail 12 may be greatly increased. Unfilled rails 12 derive their strength by themselves. That is, the wall thickness 106 typically determines the strength of the rail 12. An unfilled rail 12 is typically strengthened by increasing the thickness 106 of the rail 12 walls 105. Varying wall thickness 106 along the length of the rail 12 may greatly increase manufacturing costs. Thus, the rails 12 are typically made with a uniform wall thickness 106. In other words, the wall thickness 106 is determined by the maximum load that any portion of the rail 12 may experience. The thicker walls 105 at the locations of less loading result in dead weight. Filling a rail 12 allows for inexpensive reinforcement against buckling and distortion of strategic locations 131 that need the additional load carrying capacity without necessitating the thickening of walls 105 of the entire rail 12. As a result, great weight savings may be had.

In selected embodiments, the interior rails 20 may be completely filled with foam. In other embodiments, a foam 130 or filling material 130 may be placed periodically within the rail 12 at strategic locations 131. The strategic locations 131 may be any location requiring additional strength and rigidity. For example, in certain applications it may be advantageous to reinforce the regions where an interior rung 24 secures to the interior rail 20. The ends 132 of a rail 12 or mid-span locations that are substantially laterally unsupported may also benefit from a reinforcing filling material 130.

The filling material 130 may be applied to the rails 12 as part of their initial forming process. In other embodiments, the rails 12 may be filled at any suitable time prior to completion of assembly into a ladder 10 (e.g. before closure of tubular members). The rails 12 may be filled by inserting a wand 134 inside a closed cross-section of the rail 12. The form in which the wand 134 delivers the filling material 130 may depend on the nature of the filler 130.

For example, if the filling material 130 is an expanding foam, the material 130 may be deliver by the wand 134 in a liquid form or other form not fully expanded. Once released into the interior of the rail 12, the liquid may finish foaming (expanding) and fill the interior. As the interior of the rail 12 is filled, the wand 134 may be continuously withdrawn, thus progressively filling the entire rail 12. Periodic reinforcement may be accomplished in a similar manner differing only in that the wand 134 would apply the filling material 134 at the strategic locations 131, but not continuously.

Figure 18:
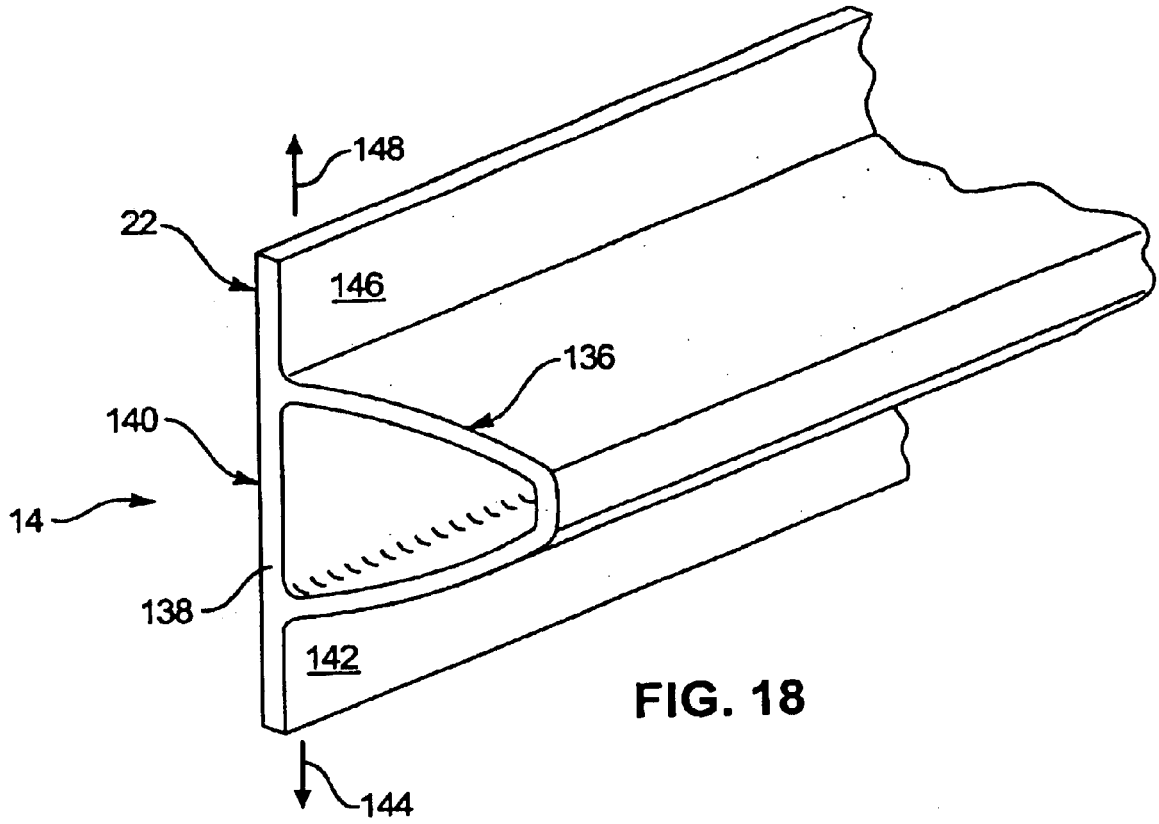
FIG. 18 is a perspective view of one embodiment of an exterior rung in accordance with the present invention.

Referring to FIG. 18, rungs 14 may be constructed of any suitable material including metal, metal alloy, composite, reinforced polymer, wood, and the like. Commonly used materials may include aluminum alloys and fiber reinforced thermoset and thermoplastic polymers. A rung 14 may be formed by any suitable process. The material selected for the rung 14 may determine which process may be most appropriate. For example, if an aluminum alloy is selected for the rung 14, an extruding process may be ideal. However, if a fiber-reinforced thermoset polymer is selected, a pultrusion process may be more appropriate.

The manufacture of multiple parts requiring many different tooling sets and assembly procedures will typically increase the cost of the final product. Thus, simple manufacturing methods requiring few assembly procedures are ideal. Constant cross-section parts lend themselves to less expensive manufacture. When the need for welding and other joining techniques is eliminated, costs can be reduced even further. Thus, a rung 14 of constant cross-section requiring no joining may be ideal or otherwise beneficial.

A rung 14 in accordance with the present invention may be manufactured by monolithically (or even homogeneously) forming a body portion 136 having a closed cross-section. In selected embodiments, one wall 138 of the body portion 136 may be substantially flat. The substantially flat side wall 138 may provide a surface 140 for securing the rung 14 against a rail 12, or the surface 140 may act as a tread for the user. The surface 140 may more conveniently be used as an interface for exterior rungs 22 and as a tread for interior rungs 24. A first rib 142 may extend in a first direction 144 away from the body portion 136 so as to be substantially co-planar with the flat wall side 138. If desired, a second rib 146 may extend parallel to or co-planar with the flat side wall 138 in a second direction 148 substantially opposite the first direction 144.

The purpose of the ribs 142, 146 may depend on the application for which the rung 14 is intended. As stated hereinabove, exterior rungs 22 may secure to the outside of the exterior rails 18 to avoid interfering with the extension of the interior rails 20 and rungs 24. In such an embodiment, the ribs 142, 146 may provide securement tabs with sufficient access for riveting, bolting, screwing, or otherwise fastening the exterior rung 22 to the exterior rail 18. The extension of the tabs away from the body portion 136 may increase the access and ease of securement while also providing increased torsion support when the exterior rung 22 is in use.

Figure 19:
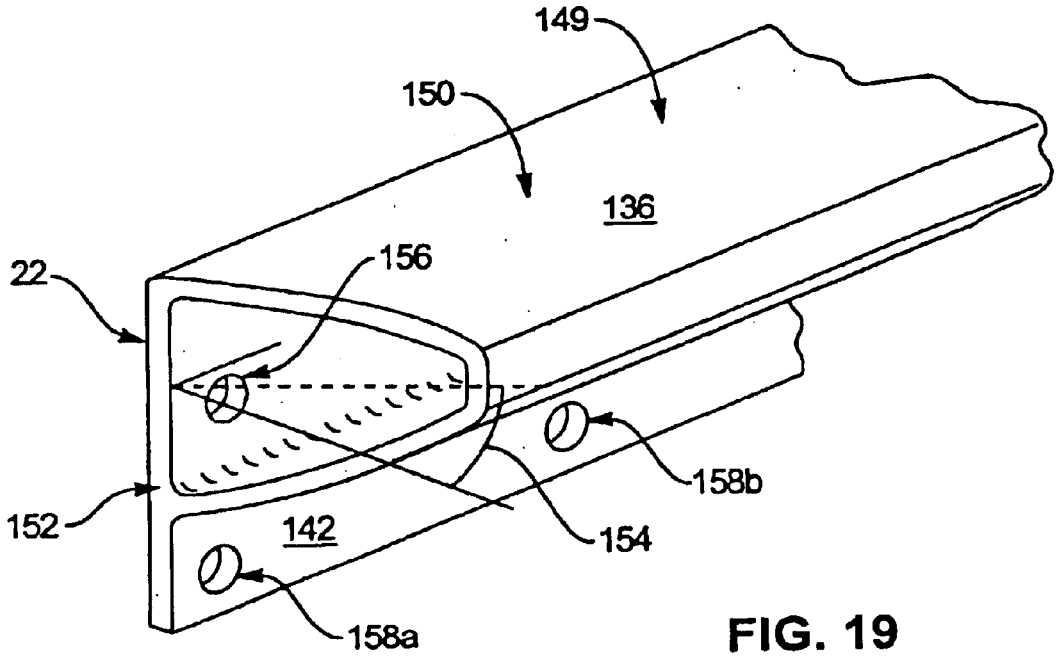
FIG. 19 is a perspective view of an alternative embodiment of an exterior rung with a single rib and apertures allowing securement to a rail and a triangulation brace in accordance with the present invention.

Referring to FIG. 19, as stated hereinabove, a single rib 142 may be provided if desired. When only one rib 142 is provided, one entire side 149 of the body portion 136 is exposed as a tread 150 for a user. The rib 142 may be sized and positioned to increase the rigidity and strength of the exterior rung 22. Additionally, the rib 142 may provide securement access and torsional resistance. In certain embodiments, the end face 152 of the exterior rung 22 may be tapered back at an angle 154 to provide easy access to a securement aperture 156 placed in the flat side wall 138. The angle 154 may be machined on the end of the exterior rung 22 once it has been cut to a proper length or as a part of the length cutting process.

Additional securement apertures 158 may be provided in the rib 142 as desired. A securement aperture 158*a* may be placed near the end of the exterior rung 22 to permit securement to an exterior rail 18. Another securement aperture 158*b* may be placed at a location spaced from the end of the exterior rung 22 to permit securement of a triangulation brace 41.

Figure 20:
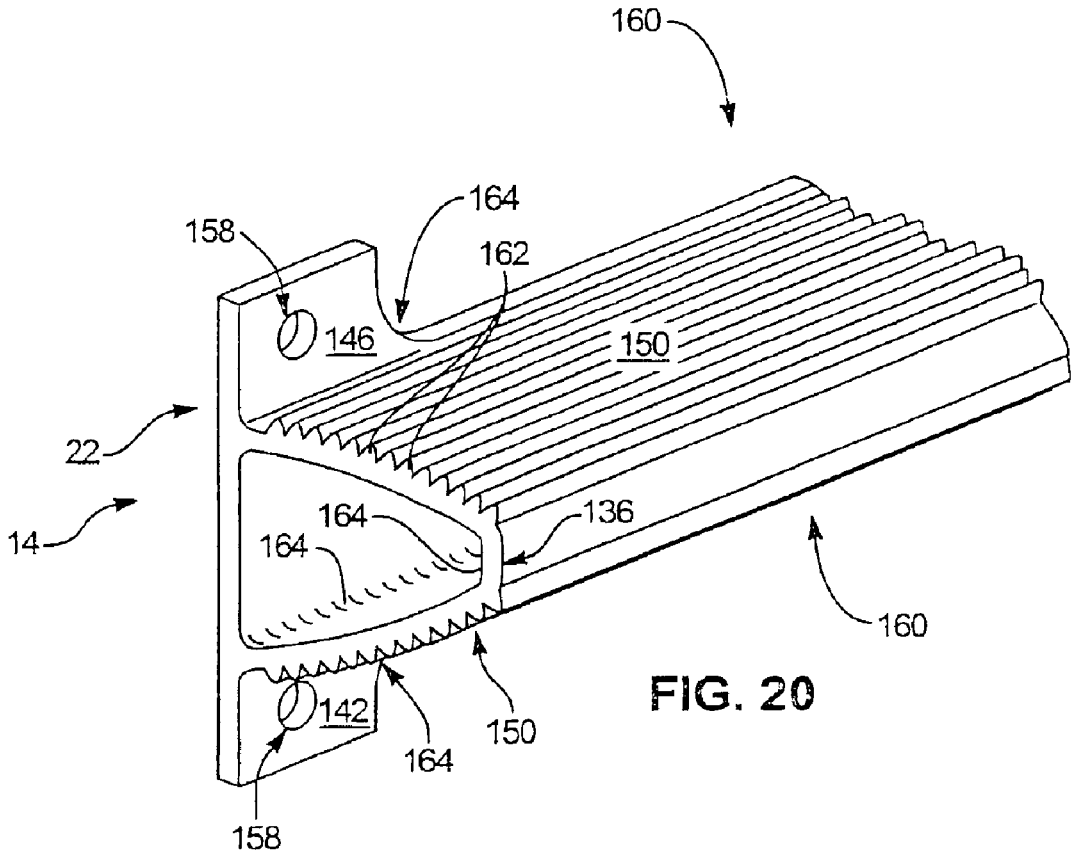
FIG. 20 is a perspective view of an exterior rung with both ribs removed along the center of the rung to provide tabs at the ends to help secure the rung to a rail in accordance with the present invention.
Figure 21:
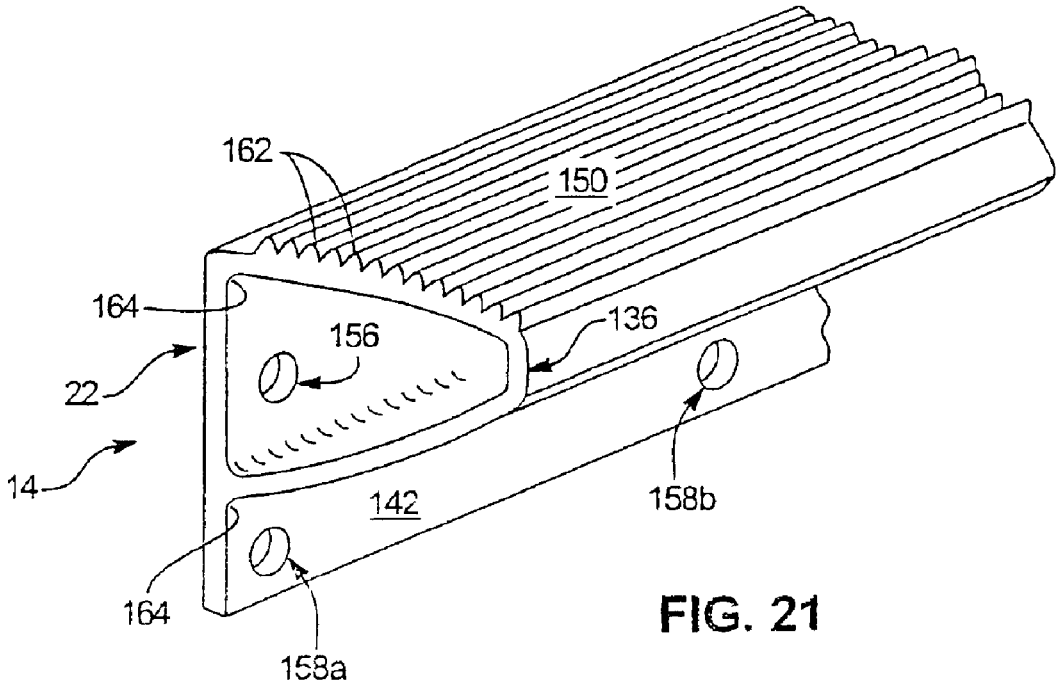
FIG. 21 is a perspective view of an exterior rung having a single rib extending from one end to the other in accordance with the present invention.

Referring to FIGS. 3, 20, and 21, in certain embodiments, portions of the first or second ribs 142, 146 may be removed from the exterior rung 22. For example, the ribs 142, 146 may be removed in a machining process along the center portion 160 to provide vertical clearance yet leave ribs 142, 146 at both ends of the exterior rung 22 for securing the exterior rung 22 to an exterior rail 18. Thus, while some of the ribs 142, 146 may need to be removed to make the exterior rung 22 useful, forming the rib 142, 146 initially as part of the exterior rung 22 allows for fast and inexpensive formation of a constant cross-section. Typically, it is simpler and less expensive to remove an unwanted rib 142, 146 section than to attach the needed ribs 142, 146.

Apertures 158 may be formed in the ribs 142, 146 to provide access for fasteners to secure the exterior rung 22 to a pair of ladder exterior rails 18. The ribs 142, 146 may extend along any selected length of the exterior rung 22. For example, the ribs 142, 146 may be relatively short to expose the great majority of the center portion 160 of the exterior rung 22 as a tread surface 150. In other embodiments, the ribs 142, 146 may extend a length sufficient to provide access for triangulation braces 41 to secure thereto.

The determination of what ribs 142, 146 to include in the initial exterior rung 22 formation and the length and portions of the ribs 142, 146 to remove once the exterior rung 22 has been formed, may be influenced by the intended use of the exterior rung 22. For example, an exterior rung 22 for a combination ladder 10 must provide two tread surfaces 150. As a result, the center portion of both ribs 142, 146 corresponding with the center portion 160 of exterior rung 22 (see FIG. 20) may be removed. When the exterior rung 22 only needs a tread surface 150 on one side, the rib 142 on the other side may extend along some portion or completely along the length of the exterior rung 22.

In selected embodiments, the tread surfaces 150 have ridges 162 or other traction devices 162 formed to improve traction of the user's foot. In certain embodiments, the corners 164 and edges 164 of an exterior rung 22 (see FIG. 21) in accordance with the present invention may be radiused to better distribute loadings and resist the formation of stress risers.

Figure 22:
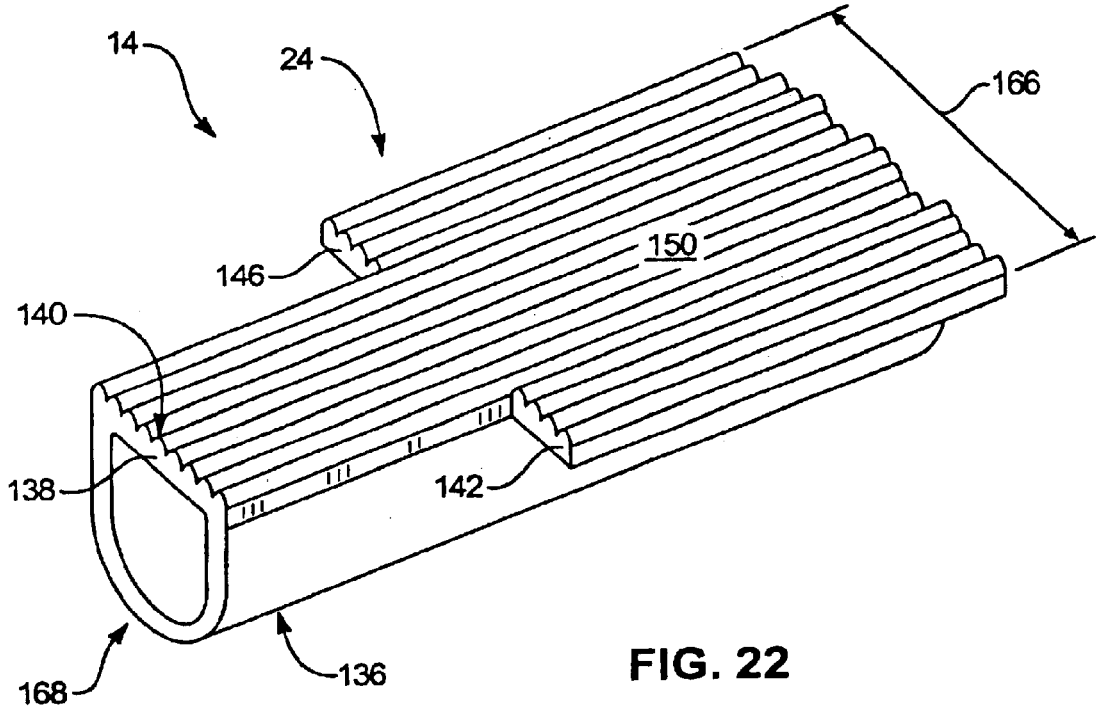
FIG. 22 is a perspective view of a single-tread interior rung with the ribs removed from the end to allow securement of the rung to a rail in accordance with the present invention.

Referring to FIG. 22, when applied to an interior rung 24, the ribs 142, 146 may increase the width 166 of the tread 150, thus, reducing user foot fatigue. In certain embodiments, an interior rung 24 may be monolithically (or even homogeneously) formed to have a body portion 136 having a closed cross-section. In selected embodiments, one wall 138 of the body portion 136 may be substantially flat. When applied to an interior rung 24, the substantially flat side wall 138 may provide a surface 140 for supporting a tread 150 for the user.

A first rib 142 may extend in a first direction away from the body portion 136 so as to be substantially co-planar with the flat wall side 138. If desired, a second rib 146 may extend co-planar with the flat side wall 138 in a second direction substantially opposite the first direction. In such an embodiment, the flat side wall 138 and first and second ribs 142, 146 may make up the tread surface 150. In certain embodiments, the tread surface 150 may have ridges 162 or other traction devices 162 formed therein to improve traction of the user.

Similar to an exterior rung 22, portions of the ribs 142, 146 of an interior rung 24 may be removed. While the ribs 142, 146 are part of the tread 150 and therefore do not need to be removed to provide access for the foot of a user, it may be advantageous to remove a portion of the ribs 142, 146 near the ends of the interior rung 24 to allow securement of the interior rung 24 to an interior rail 20.

Figure 23:
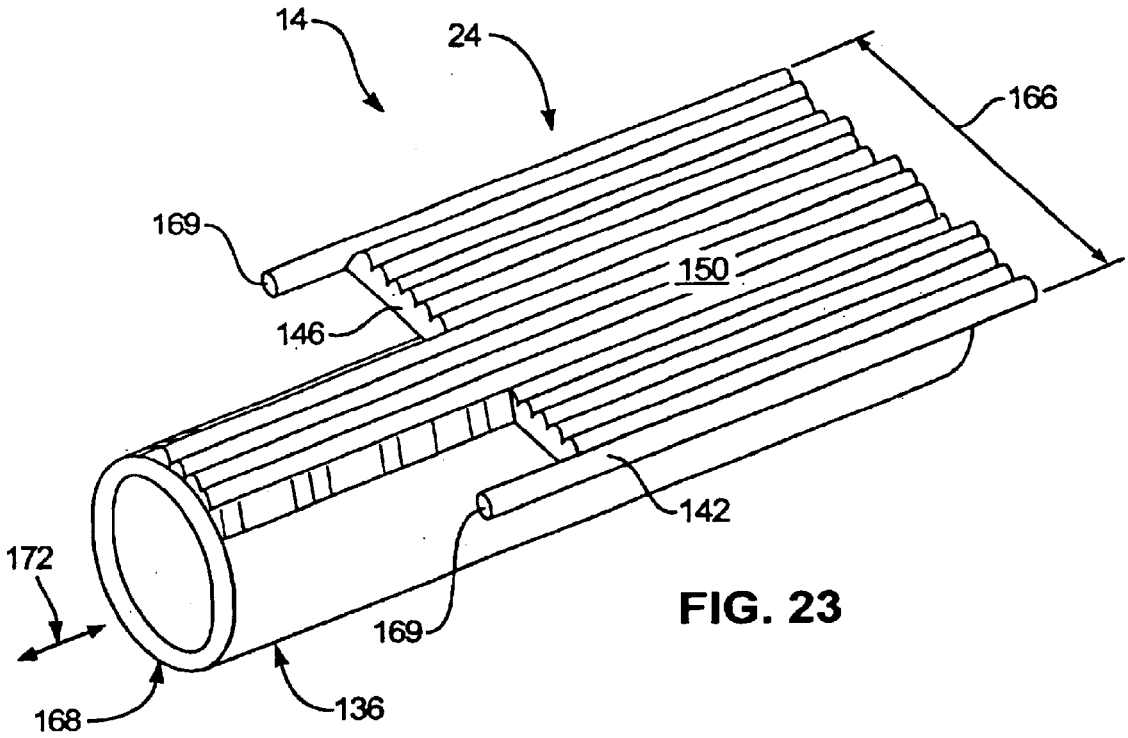
FIG. 23 is a perspective view of an alternative embodiment of a single-tread interior rung with the ribs removed from the end to allow securement of the rung to a rail in accordance with the present invention.

Referring to FIG. 23, the body section 136 of an interior rung 24 may have any suitable cross-section. For example, the body section 136 may be circular, elliptical, rectangular, triangular, another shape, or some combination thereof. In FIG. 23, a circular cross-section is illustrated. In such an embodiment, the flat side wall 138 has the first and second ribs 142, 146 extending tangentially from the circular body section 136. If desired, prongs 169 may be formed when unwanted rib 142, 146 sections are removed. The prongs 169 may engage a corresponding interior rail 20 to resist rotation of the interior rung 24 with respect thereto about a central axis 172.

Figure 24:
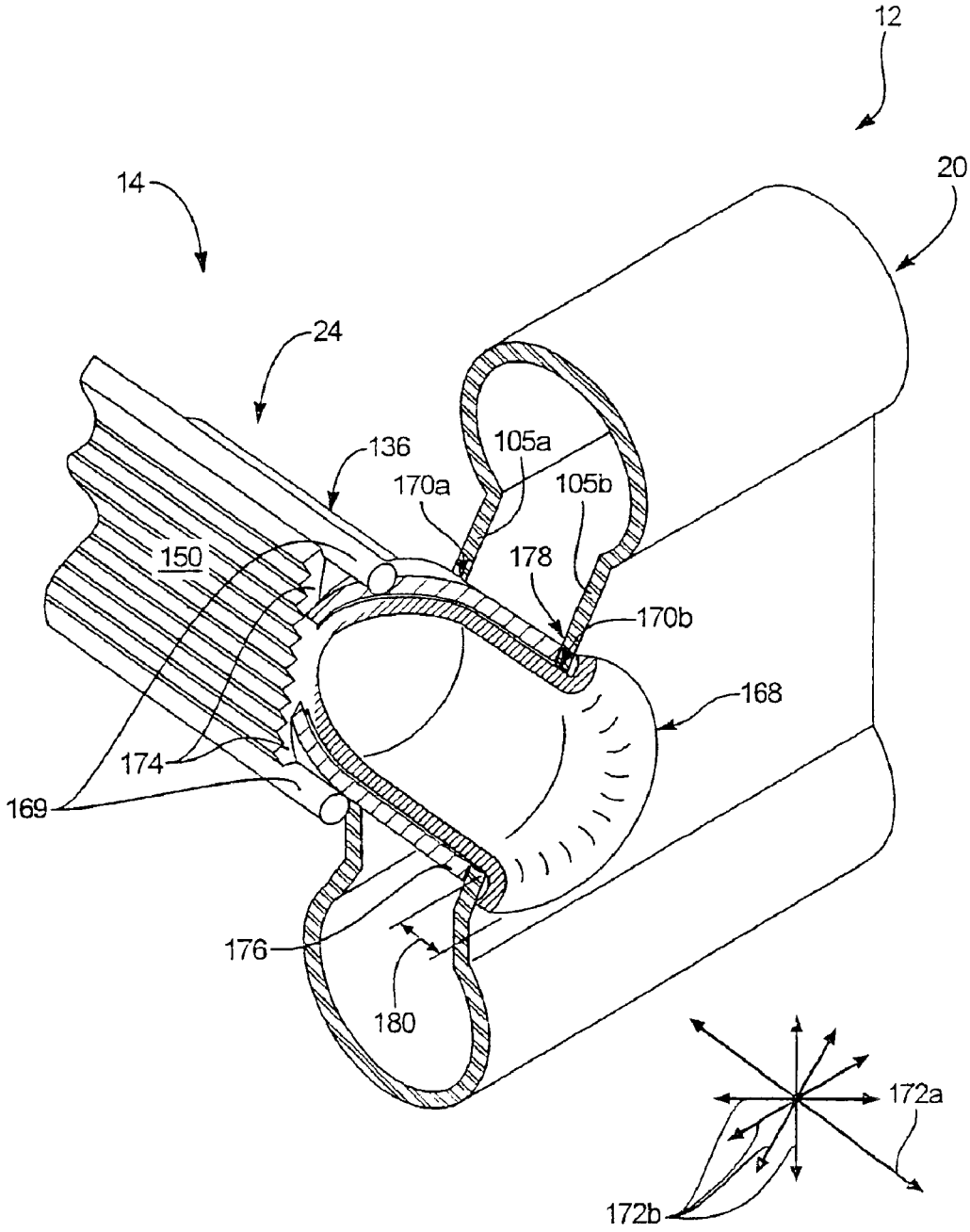
FIG. 24 is a cut-away, perspective view of the rung of FIG. 23 interfacing with an interior rail using a swaging collar in accordance with the present invention.

Referring to FIG. 24, the interior rungs 24 of ladder 10 must be secured to the interior rails 20 in a manner to distribute the loads so as not to overload any particular point. One method for securing an interior rung 24 to an interior rail 20 involves inserting a tubular portion of an interior rung 24 through an aperture 170*a*, 170*b* in the interior rail 20 and then swaging the end 168 of the interior rung 24 to produce a rivet-like effect, maintaining the interior rung 24 securely against the interior rail 20. As discussed hereinabove, thin side walls 105*a*, 105*b* reduce the overall weight of the ladder 10. However, bending forces in thin side walls 105*a*, 105*b* on an interior rail 20 complicate interior rung 24 securement. That is, with thin side walls 105, the swaging may result in distortion, fracture, crushing, or breaking of the interior rail 20.

A reinforcement method for reducing and substantially eliminating damage or fracture of the interior rail 20 is within the scope of the present invention. This method may first include providing an interior rung 24 defining an axial direction 172*a* and a radial direction 172*b*. The rung may comprise a body portion 136 or tube 136 having an end 168 with a stop 174 spaced therefrom in an axial direction 172*a*. A collar 176 may be provided to fit radially around the tube 136 and rest axially against the stop 174.

The interior rail 20 to which the interior rung 24 is to be secured may have a closed cross-section defining two walls 105*a*, 105*b*, each wall 105 having an aperture 170 formed therethrough. The first aperture 170*a* may be sized to fit around the collar 176 and the second aperture 170*b* may be sized to fit around the tube 136. Thus, the first aperture 170*a* is larger than the second aperture 170*b*. The interior rung 24 and interior rail 20 may be secured together by placing the collar 176 radially around the tube 136 and axially against the stop 174.

The tube 136 may then be inserted with the collar 176 through the first aperture 170*a* in the interior rail 20. Once the collar 176 and tube 136 have passed through the first aperture 170*a,* the tube 136 may be advanced through the second aperture 170*b*. Due to the sizing of the second aperture 170*b*, the collar 176 is unable to pass therethrough. Thus, the collar 176 may become pinched between the second aperture side wall 105*b* and the axial stop 174 of the interior rung 24.

The tube 136 may have a length selected so that, when the collar 176 comes in contact with the internal side 178 of the second aperture 170*b*, the tube 136 is still able to extend out a selected distance 180. Thus, when the tube 136 is in proper alignment with the collar 176 and interior rail 20, the end 168 of the tube 136 may be swaged to form a rivet head and maintain the interior rail 20 and collar 176 pressed snugly against the axial stop 174 on the rung 24. In such a configuration, the collar 176 may support the swaging load and protect the interior rail 20 from crushing.

Figure 25:
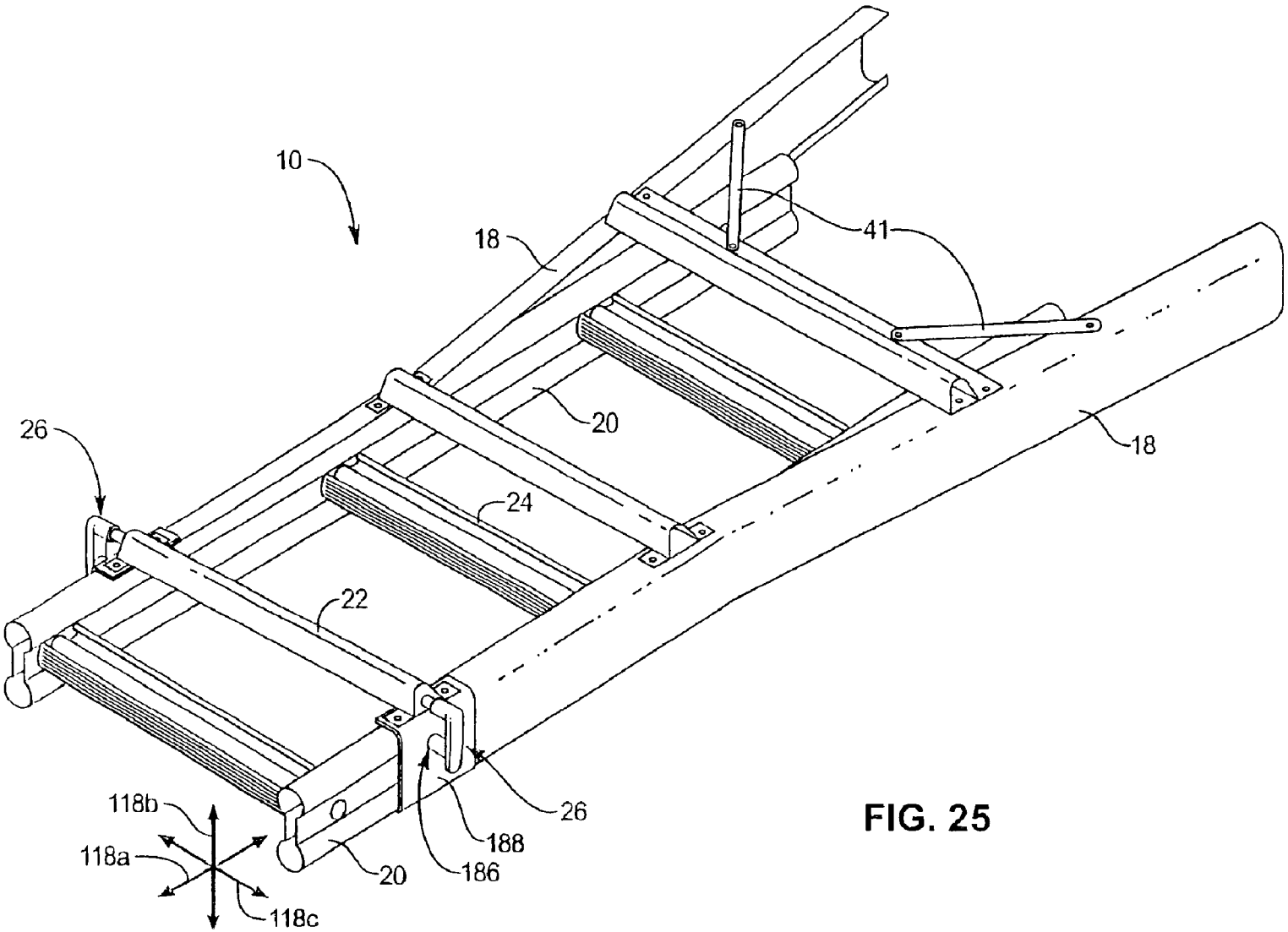
FIG. 25 is a perspective view of assembled interior and exterior rail pairs showing the relationship of an extension lock in accordance with the present invention.
Figure 26:
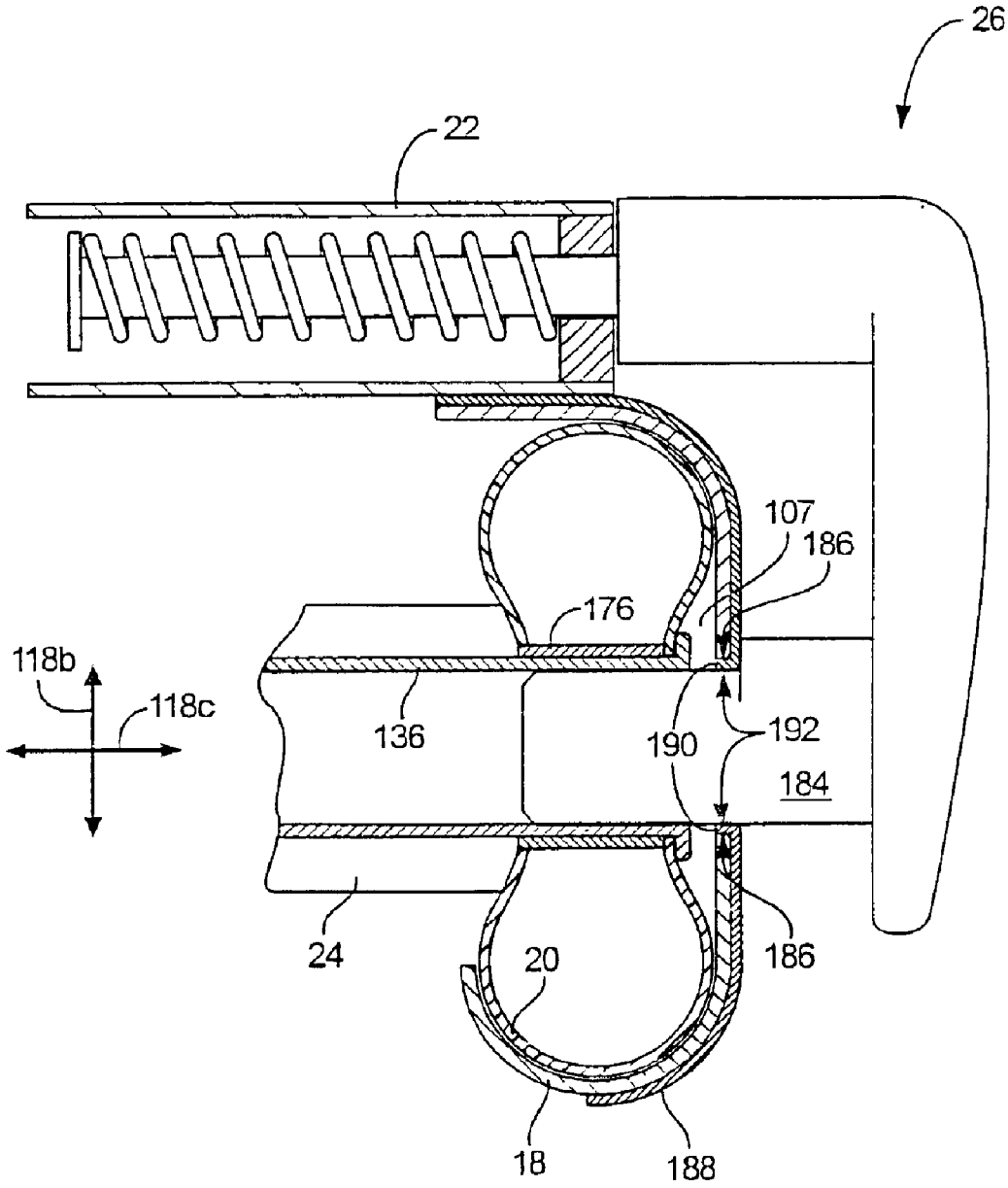
FIG. 26 is a cross-sectional view of an extension lock reinforcement in accordance with the present invention.

Referring to FIGS. 25 and 26, an extension lock 26 may secure an interior rail 20 with respect to an exterior rail 18 and resist motion in a longitudinal direction therebetween. Thus, when a load is applied to the interior rails 20, the extension lock 26 must transfer that load to the exterior rails 18, which, in turn, transfer the load to the supporting surface 44 (FIG. 3). When the load applied to interior rails 20 is large, the extension lock 26 is sufficiently strong to support the load.

In certain embodiments, an extension lock 26 may include a shear pin 184 engaging both an interior rail 20 and an exterior rail 18. Typically, the shear pin 184 passes through an aperture 186 in the exterior rail 18 and engages the tube 136 or body portion 136 of an interior rung 24 secured to an interior rail 20.

Fiber-reinforced composites, and even metals, are susceptible to failure, such as by splitting, when loaded in a comparatively small area or effectively at a point. Thus, to resist the failure or splitting tendency, the loads applied by an extension lock 26 may be distributed by reinforcements. For example, the tube 136 of the interior rung 24 may house the shear pin 184 and distribute the loads applied thereto. A reinforcing plate 188 may be applied to the exterior rail 18. The reinforcing plate 188 may be formed of any suitable material. In one embodiment, the plate 188 is formed of a metal or metal alloy such as aluminum, the more ductile steel, or the like.

In certain embodiments, the reinforcing plate 188 may be sized to withstand the entire load imparted by the shear pin 184. In an alternative embodiment, the plate 188 may act to resist the splitting tendency of the exterior rail 18 rather than carry the load applied by the shear pin 184. For example, a thin plate 188 may be secured to the exterior on an exterior rail 18. Suitable machinery may punch an aperture 186 through both the plate 188 and the side wall 105 of the exterior rail 18. The punch may be shaped and applied in a manner to also deform rather than simply cut the reinforcing plate 188, thus, pulling or drawing a portion of the plate 188 through the aperture 186.

The distorted surface or even edges 190 of the plate 188 around the aperture 186 may become the bearing surface 192 between the shear pin 184 and the aperture 186 in the exterior rail 18. In such a manner, even a plate 188 that is not thick enough to alone withstand the loads applied by the shear pin 184 may carry or distribute to exterior the rail 18 enough of the load at the bearing surface 192 to prevent splitting of the exterior rail 18 and then let the rail 18 carry the rest of the load. A comparatively thinner reinforcement plate 188 may provide additional weight savings for the ladder 10.

Figure 27:
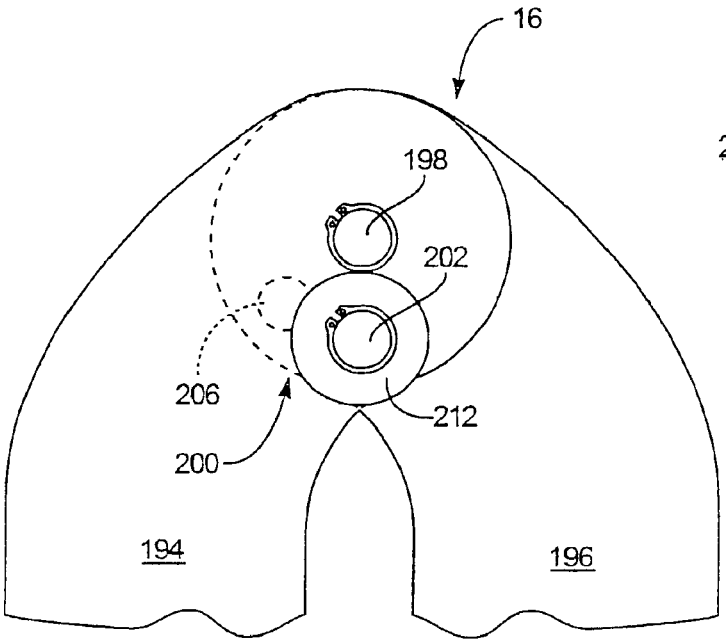
FIG. 27 is a front elevation view of an "A-frame" or step-ladder locking hinge in a closed position in accordance with the present invention.
Figure 28:
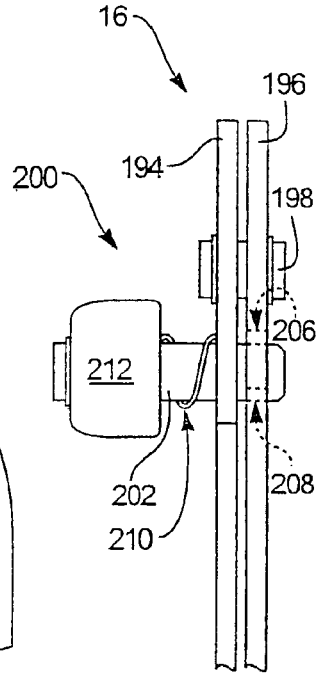
FIG. 28 is a side elevation view of the hinge in FIG. 27.
Figure 29:
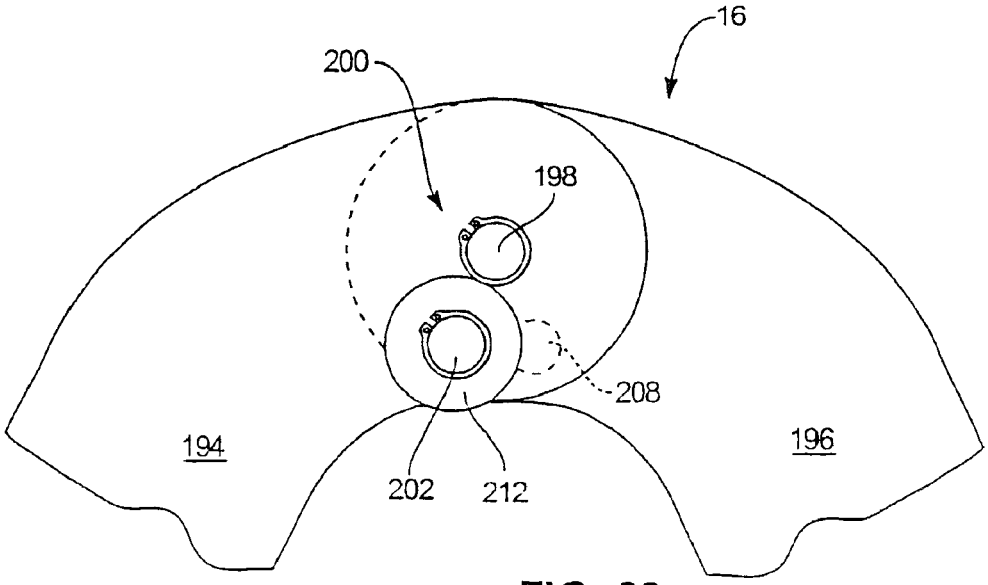
FIG. 29 is a side elevation view of the hinge of FIG. 27 locked in an open position in accordance with the present invention.

Referring to FIGS. 27–29, as discussed hereinabove, hinges 16 for step ladders 10 need not support the moment loads of hinges 16 designed for combination ladders 10. Thus, a hinge 16 for a step ladder 10 may have a much lighter and simpler construction.

In certain embodiments, a hinge 16 for a step ladder 10 may include a first armature 194 connected to a second armature 196 by a pivot pin 198. A lock 200 may provide two locking positions, a closed position (see FIG. 27) and an open position (see FIG. 29). The lock 200 may consist of a shear pin 202 occupying a locating aperture 204 (see FIG. 30) in the first armature 194.

When the locating aperture 204 is aligned with either an open aperture 206 or a closed aperture 208 of the second armature 196, a biasing member 210 urges the shear pin 202 therethrough, thus locking the armatures 194, 196 in a fixed relation (either open or closed) with respect to one another. The lock 200 may be released by pulling, a knob 212 secured to the shear pin 202 in a direction opposite to that urged by the biasing member 210, thus removing the shear pin 202 from either the open aperture 206 or a closed aperture 208 and permitting relative motion between the armatures 194, 196.

Figure 30:
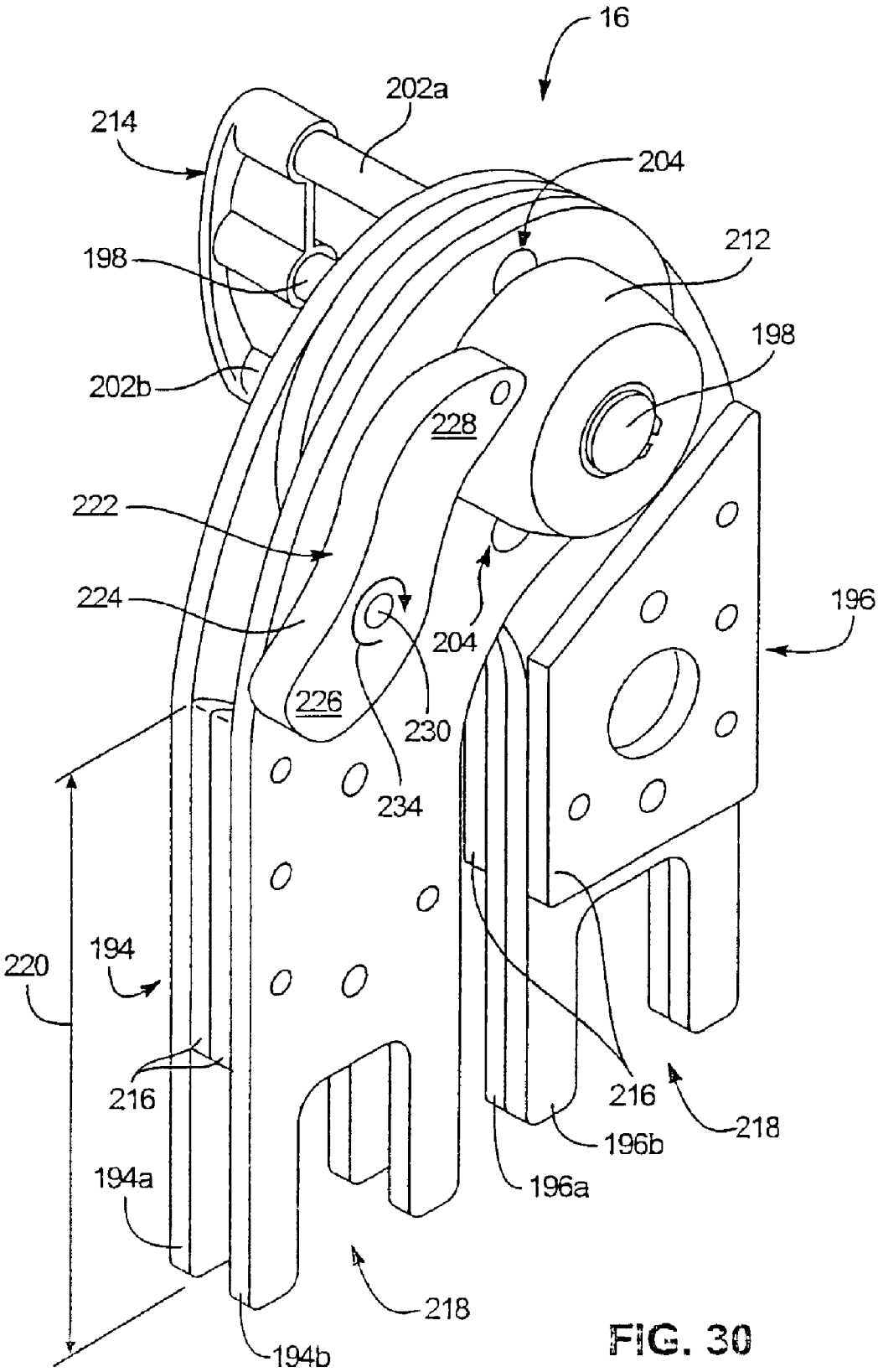
FIG. 30 is a perspective view of a step-to-straight ladder hinge in a closed position with the lock and the interlock both in disengaged positions in accordance with the present invention.
Figure 31:
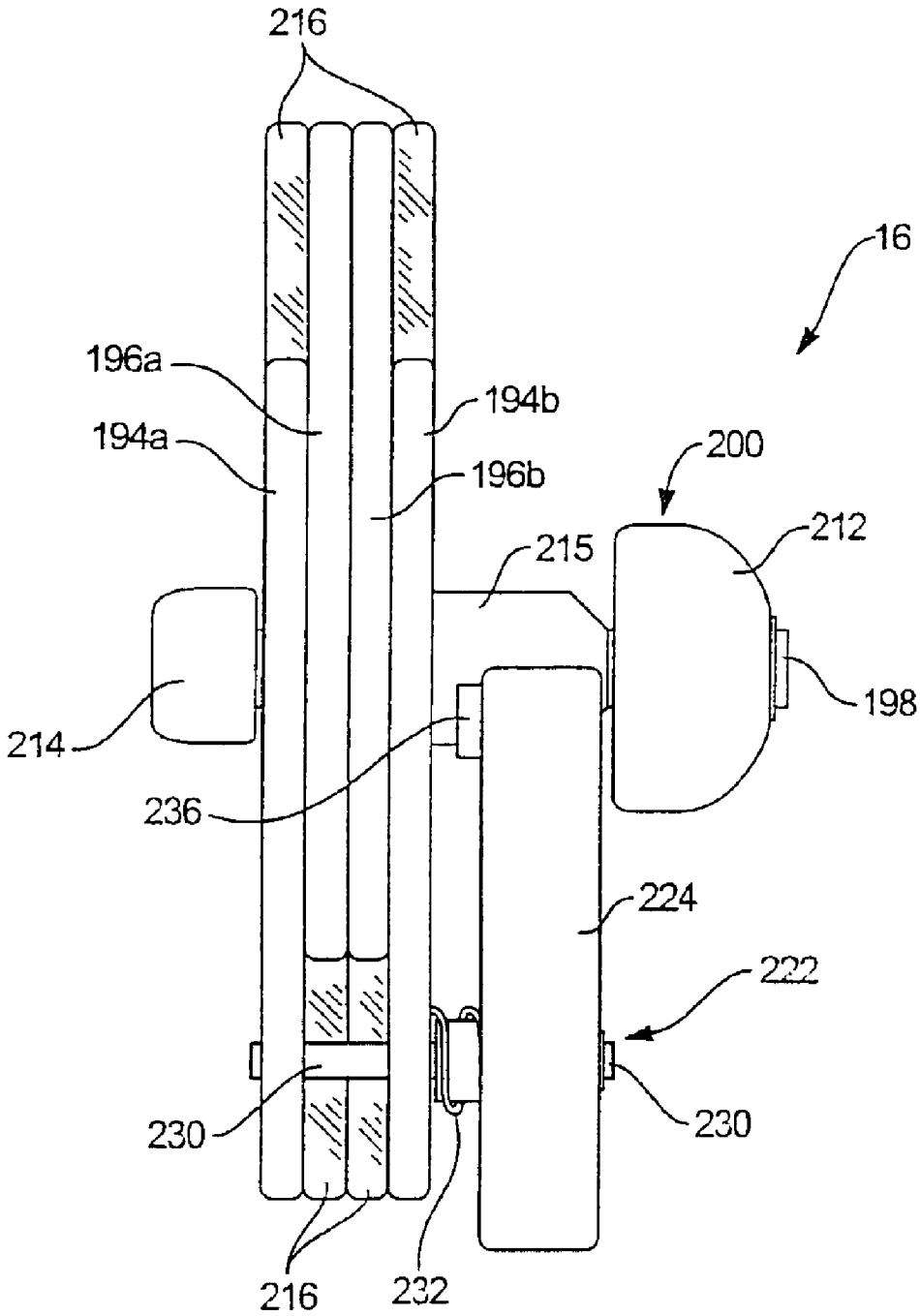
FIG. 31 is a top view of a step-to-straight ladder hinge in a straight position with a lock and interlock both in engaged positions in accordance with the present invention.
Figure 32:
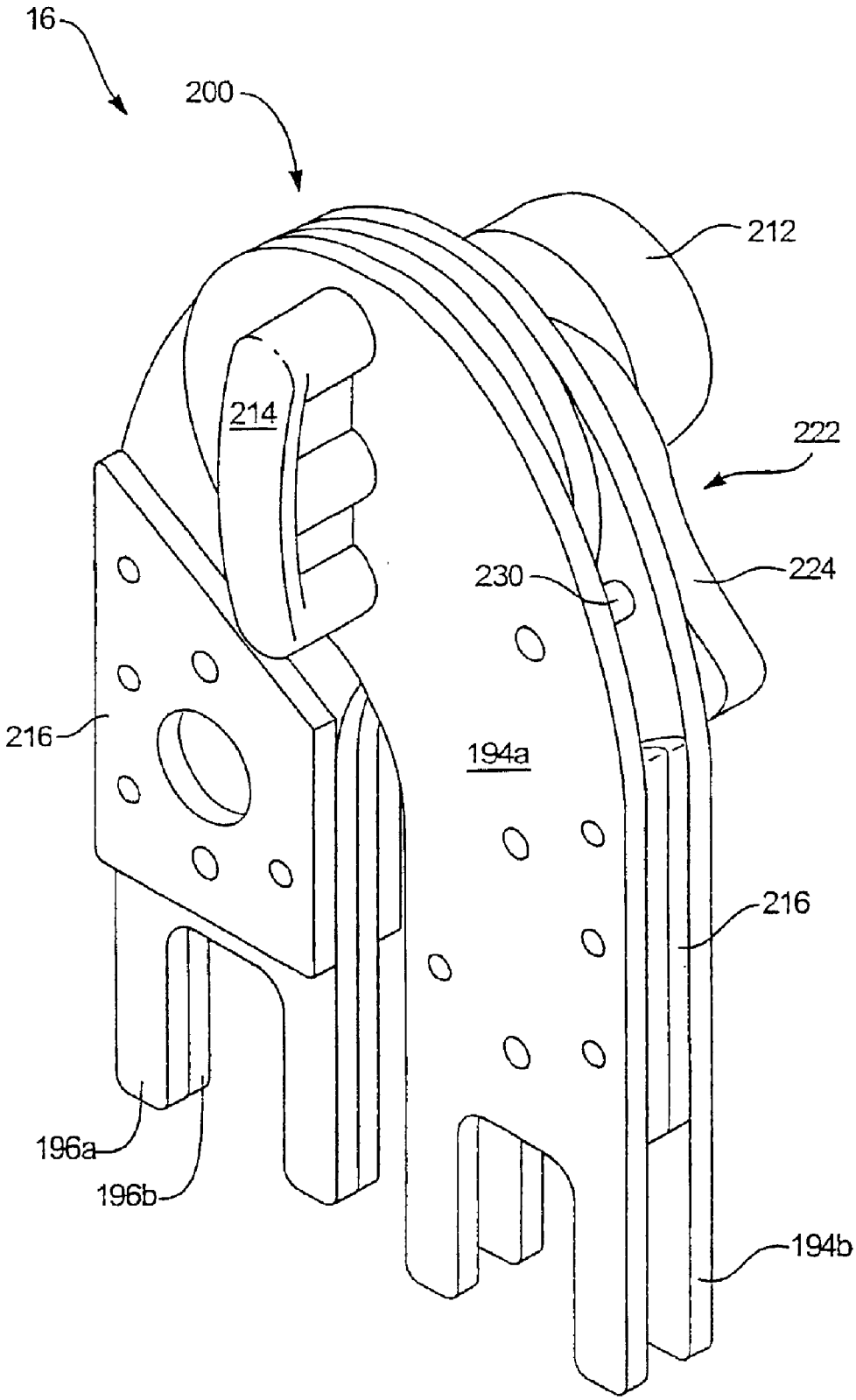
FIG. 32 is a perspective view of a step-to-straight ladder hinge in a closed position with the lock and the interlock both in engaged positions in accordance with the present invention.

Referring to FIGS. 30–32, hinges 16 for use with a combination ladder 10 may require a heavier construction to withstand the higher moment loads that may be imposed thereon. A hinge 16 for a combination ladder 10 may include a first armature 194 connected to a second armature 196 by a pivot pin 198 or axle 198.

A hinge 16 in accordance with the present invention may be constructed of any suitable material. The particular weight and strength requirements of the ladder 10 design may influence the choice of material. In certain embodiments, the hinge 16 material is selected from the group including a metal, metal alloy, composite, polymer, fiber reinforced polymer, or the like. Hinge 16 components may likewise be selected of any suitable material. The loadings that the component must withstand may greatly influence the material selection. For example, components that must resist high shear loads may best be constructed of a metal or metal alloy, although other materials having adequate strength may be used as well.

In certain embodiments, a hinge 16 may have armatures 194, 196 restricted in their respective pivotable motion by locking pins 202 or shear pins 202. The pins 202 may be selectively engaged and disengaged by linearly maneuvering a knob 212. The lock 200 operates by moving between a first, engaged, position (see FIGS. 31 and 32) and a second, disengaged, position (see FIG. 30). To engage the lock 200, the knob 212 is pulled away from the armatures 194, 196 with the aid of a biasing force, drawing therewith the locking pins 202 into properly aligned apertures in both the first armature 194 and in the second armature 196.

Two locating apertures 204 are provided in the first armature 194 and three corresponding pairs of apertures are provided in the second armature 196. The first pair of apertures is positioned to align with the locating apertures 204 of the first armature 194 in the straight configuration. The second pair of apertures is positioned to align with the locating apertures 204 of the first armature 194 in the step ladder configuration. The third pair of apertures is positioned to align with the locating apertures 204 of the first armature 194 in the closed configuration.

The second, or disengaged, position results from a user forcing the knob 212 to move against the biasing force, thus retracting the pins 202 from the apertures of the second armature 196. A frame 214 may connect the pivot pin 198 to the pins 202 enabling the release knob 212 to move the locking pins 202*a*, 202*b* in unison.

The urging force tending to position the pins 202 in the engaged position, may be provided by a spring apparatus in a housing 215. Suitable fasteners, spring mechanisms, and the like may be captured in the housing 215 for biasing the pins 202 toward the engaged position. One suitable embodiment for such a hinge 16 is described in U.S. Pat. No. 4,697,305, incorporated herein by reference.

To promote a stable connection between the armatures 194, 196 and the interior rails 20, spacers 216 may fit between or around plates 194*a*, 194*b*, 196*a*, 196*b* of the respective armatures 194, 196. The spacers 216 and armatures 194, 196 may combine to provide a location for the interior rails 20 to secure thereto. In certain embodiments, the armatures 194, 196 may have a relief 218 formed therein for fitting about interior rungs 24 or other structures. Thus, the length 220 of the armatures 194, 196 may be increased, while avoiding interference with obstructing components.

In certain embodiments, an interlock 222 may provide an additional protection against inadvertent release of a hinge 16. An interlock 222 may be a simple mechanism that can be operated simultaneously with actuation of the release knob 212 by a single hand of a user. Such one-handed operation, however, should not be readily executable by accident. An interlock 222 in accordance with the present invention may operate by resisting translation of the shear pins 202. This may be accomplished in any suitable manner. For example, an interlock may engage the frame 214 to selectively prevent the shear pins 202 from being extracted. In another embodiment, an interlock 222 may be inserted in between the release knob 212 and the first armature 194, thus, selectively preventing the lock 200 from opening. That is, if the release knob 212 is held away from the first armature 194, the shear pins 202 cannot be extracted and the lock 200 will not release.

An interlock 222 may operate in a pivoting motion, a sliding motion, or any other rotary or translational motion. A post, a spring-loaded key, a cross-pin engaging the pivot pin 198, or the like may be employed. In certain embodiments, an interlock 222 in accordance with the present invention may include a lever 224 with an actuator 226 at one end and a stop 228 at the other. The lever 224 may be constructed to pivot on a pivot pin 230. A biasing member 232, such as a coil spring, may urge the lever 224 in a selected direction 234.

The direction 234 may be selected to urge the stop 228 in-between the release knob 212 and the first armature 194 whenever the lock 200 is in an engaged position. Thus, if the release knob 212 is accidentally hit, the stop 228 prevents the release knob 212 from translating and extracting the shear pins 202. To release the lock 200, a user may press the actuator 226 in a manner to counteract the biasing member 232 and produce a motion opposite that of the biasing direction 234. Once the stop 228 is no longer obstructing the motion of the release knob 212, the knob 212 may be urged to extract the shear pins 202 and disengage the lock 200.

In certain embodiments, a support 236 or standoff 236 may provide spacing and strength for appropriately resisting motion of the release knob 212. The support 236 may be built in as a monolithic, integral, or even homogeneous part of the stop 228, or may be added as a separate material or appendage.

Figure 33:
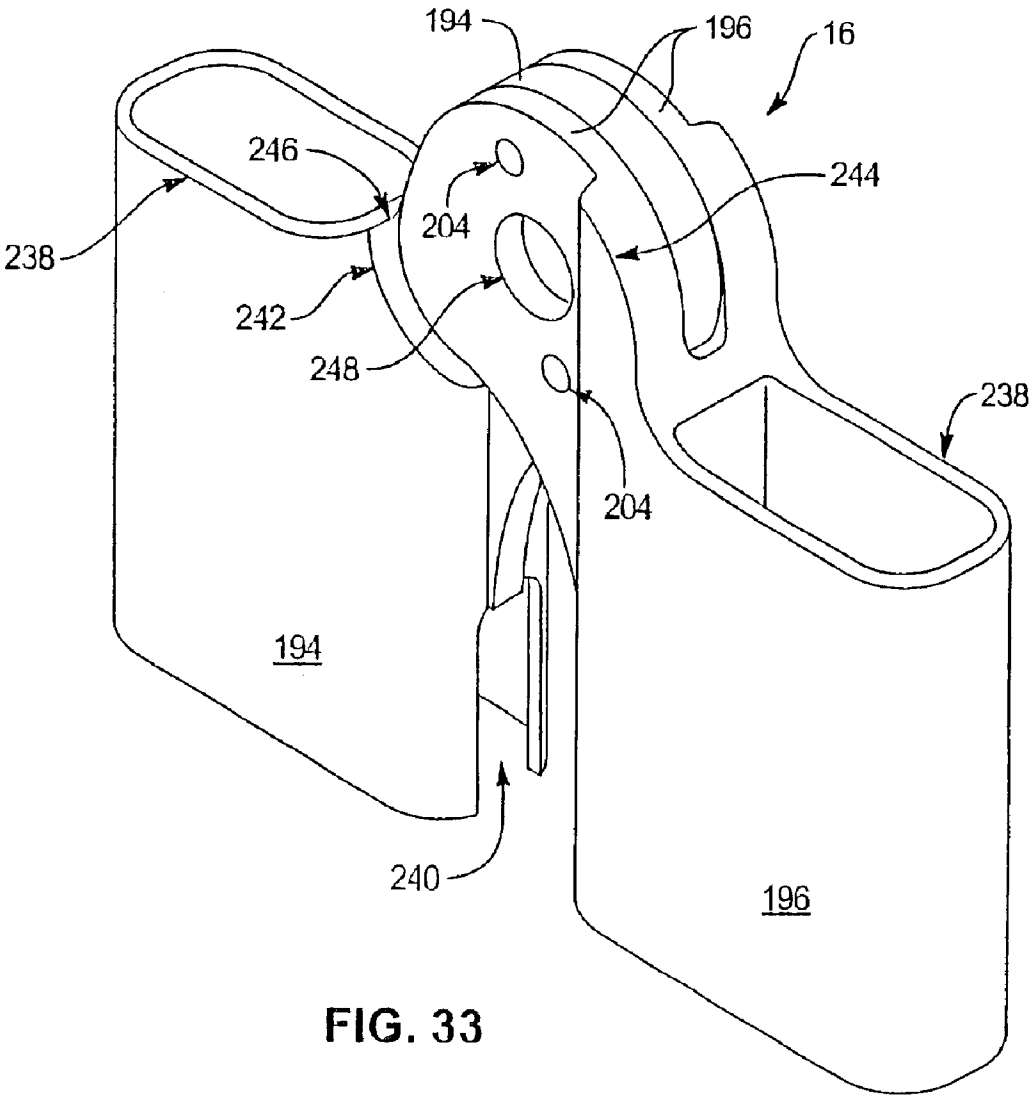
FIG. 33 is a perspective view of an alternative embodiment of a step-to-straight ladder hinge in a closed position in accordance with the present invention.
Figure 34:
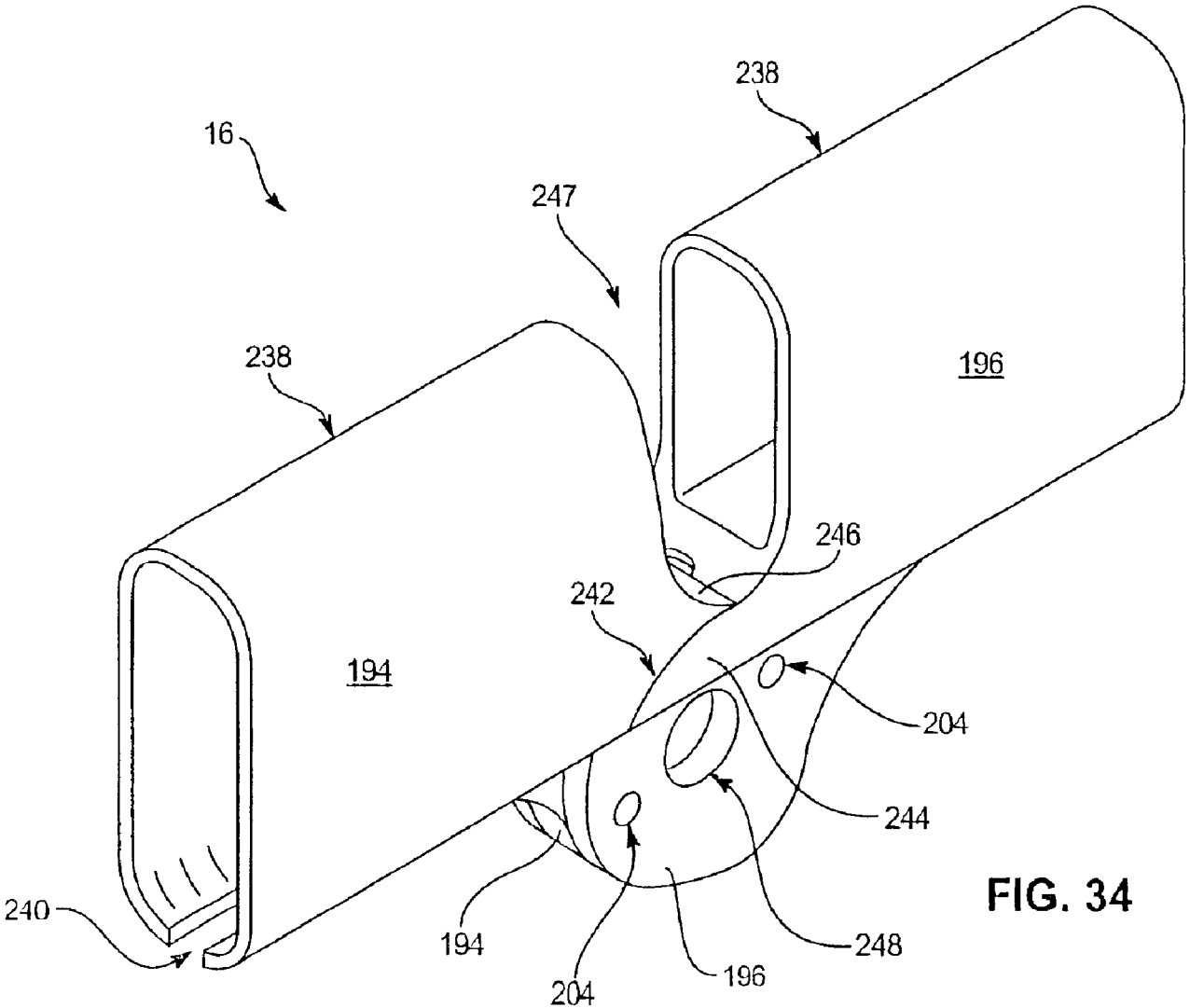
FIG. 34 is a perspective view of the step-to-straight ladder hinge of FIG. 33 in an open position in accordance with the present invention.

Referring to FIGS. 33 and 34, the armatures 194, 196 illustrated in FIGS. 30–32 are configured to be contained within the interior rails 20 to which they secure. In alternative embodiments, it may be advantageous to provide armatures 194, 196 with a housing 238 to capture the end on the interior rail 20 to which the hinge 16 is to secure. The housing 238 may be shaped to snugly surround an end of the corresponding intrior rail 20.

Recesses 240 may be formed at strategic locations throughout the housing 238 to provide for a better fit with the corresponding interior rail 20. The housing 238 may provide for a distributed engagement, thus reducing the individual point loadings and accompanying stress risers that may result from the use of screws or other fasteners. The housing 238 may be bonded to the interior rail 20 to further promote an efficient load distribution. As discussed hereinabove, hinges 16 in accordance with the present invention may be constructed of any suitable material including metal, metal alloy, composite, polymer, fiber reinforced polymer, or the like.

In selected embodiments, the housings 238 of the armatures 194, 196 may engage one another. In certain embodiments, a notch 242 may be formed in the first armature 194. A corresponding extension 244 may be formed in the second armature 196. The notch 242 may have a stop 246 formed therein. As the hinge 16 opens and reaches the straight configuration (see FIG. 34) the stop 246 may engage the extension 244 and resist further rotation of the hinge 16. Thus, the engagement between the first and second armatures 194, 196 may reduce the shear loading of the shear pins 202. Additionally, the engagement between the first and second armatures 194, 196 may provide an additional safeguard against complete release of the hinge 16.

While portions of the housings 238 of the first and second armatures 194, 196 may meet (i.e. the notch 242 and extension 244), the rest of the housings 238 need not meet. If desired, the housings 238 may be shaped to leave a gap 247 therebetween when the hinge 16 is in the straight configuration (see FIG. 34). The gap 247 may reduce the likelihood of the user pinching a finger, hand, or the like therein while opening or closing the ladder 10.

FIGS. 33 and 34 do not illustrate the components and mechanisms necessary or contemplated to complete a functioning hinge 16. Merely the locating apertures 204 and a pivot pin aperture 248 are shown. However, the components and methods discussed in connection with FIGS. 30–32 may be applied to provide suitable pivoting and locking as desired. It should be noted that other hinge componentry may be applied as well and is contemplated within the scope of the present invention.

Referring to FIGS. 35–48, as mentioned hereinabove, hinges 16 may pinch a user's finger, hand, or the like, while opening or closing the ladder 10. Such pinches may result in serious injury. Several methods and structures are available to protect the user from injury.

Figure 35:
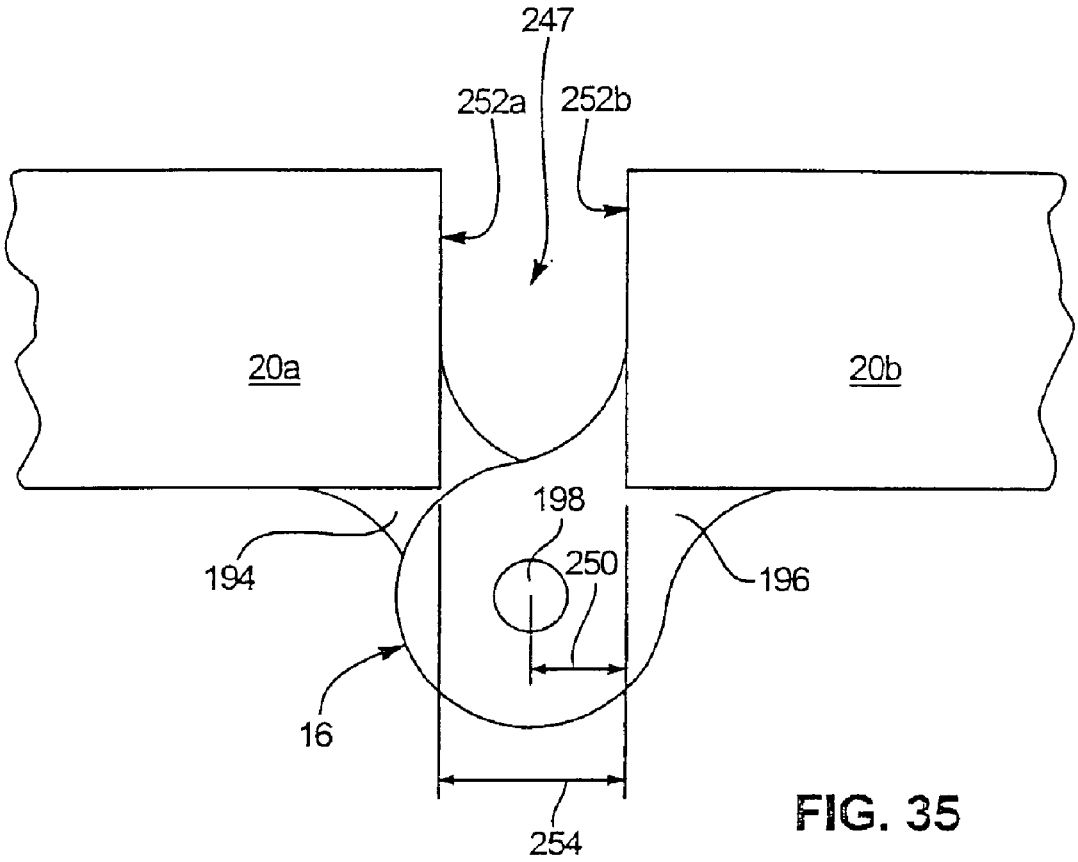
FIG. 35 is a side elevation view of a ladder hinge and rail combination in a straight position with a non-pinch-point configuration in accordance with the present invention.
Figure 36:
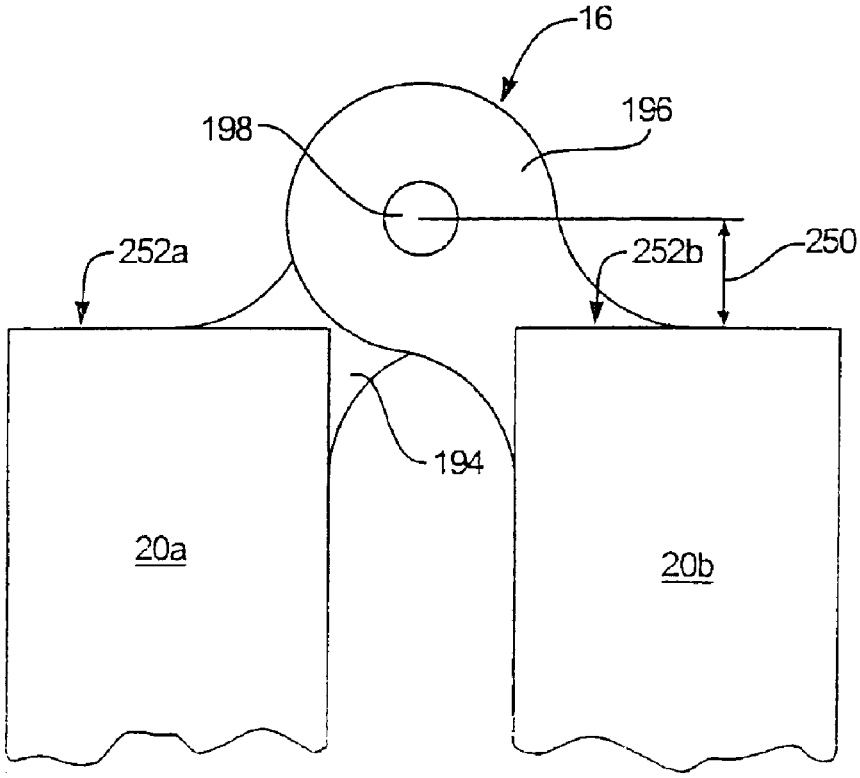
FIG. 36 is a side elevation view of the hinge and rail combination of FIG. 35 in a closed position in accordance with the present invention.

Referring to FIGS. 35 and 36, in certain embodiments, it may be advantageous to have a hinge 16 with no pinch point. This may be accomplished by spacing the pivot pin 198 a selected distance 250 away from the end face 252*a*, 252*b* of the interior rail 20*a*, 20*b*, which may comprise a housing 238. Thus, in the embodiments where the armatures 194, 196 include a housing 238, the pivot pin 198 may be spaced a selected distance 250 away from an end face 252 of the housing 238. The pivot pin 198 maybe spaced the same distance 250 from both end faces 252*a*, 252*b*. Thus, when the hinge 16 is in the straight configuration, the end faces

252*a*, 252*b* are separated a distance 254 substantially equivalent to twice the spacing of the pivot from one of the faces 252*a*, 252*b*. The separation distance 254 creates a gap 247 and removes any pinch point that may have been present had the end faces 252*a*, 252*b* met with the hinge 16 in the open configuration.

In addition to creating a gap 247 and eliminating potential pinch points, other methods and structures are available to safeguard a user. For example, a shield 256 may provide a mechanical stop for preventing a user's fingers or the like from ever entering the pinch point. A pinch point results when the end faces 252*a*, 252*b* come in contact with one another. A shield 256 may resist any part of a user from coming into the pinch point as the end faces 252*a*, 252*b* come in contact with each other.

Figure 37:
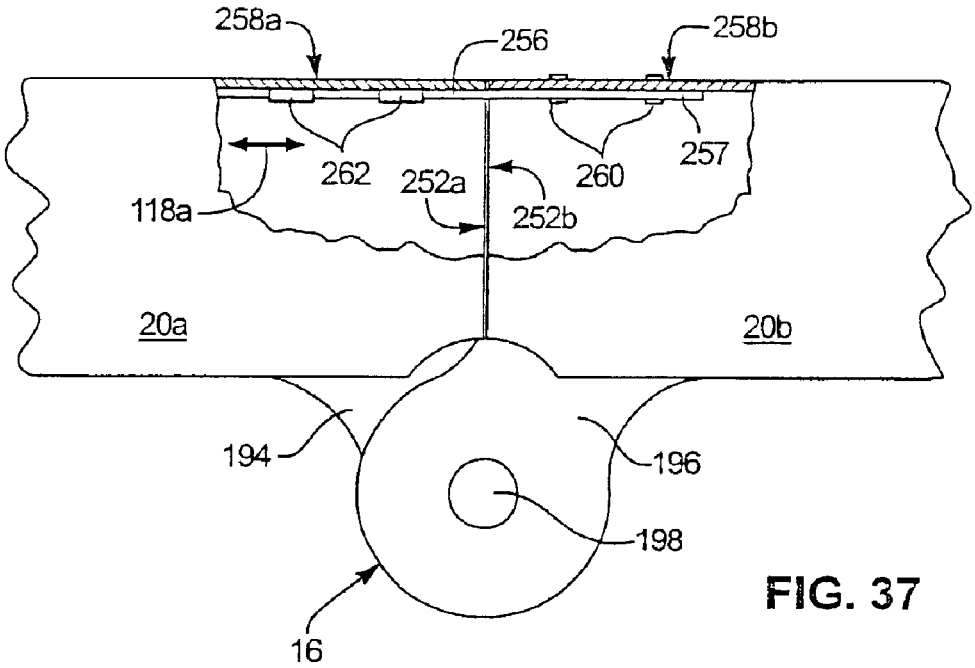
FIG. 37 is a side elevation view of a ladder hinge and rail combination in a straight position with an embodiment of a pinch point guard in accordance with the present invention.
Figure 38:
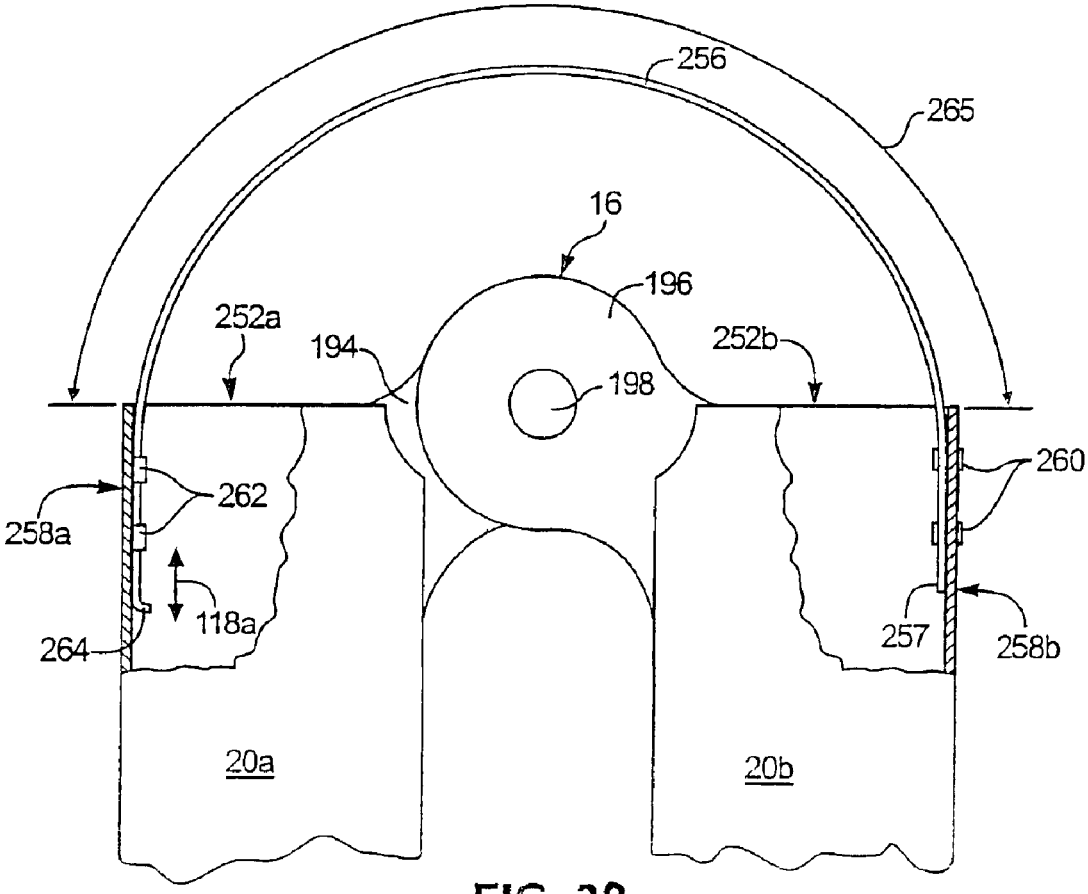
FIG. 38 is a side elevation view of the hinge and rail combination of FIG. 37 in a closed position in accordance with the present invention.

Referring to FIGS. 37 and 38, in selected embodiments, the shield may be a flexible band 256. The band 256 may be constructed of any suitable material. In selected embodiments, the band 256 is made from either metal, metal alloy, composite, polymer, reinforced polymer, or the like. The band 256 may secure at one end 257 to an outside wall 258*b* of the interior rail 20*b*. The end 257 of the band 256 may be secured to the outside wall 258*b* by any suitable method or structure.

In one embodiment, the band 256 is held in place by fasteners 260. The other end 264 of the band 256 may be free to travel in a longitudinal direction 118*a* within a guide 262 or within multiple guides 262. Thus, as the hinge 16 travels through its range of motion, the band 256 may adjust by sliding within the guides 262 to accommodate changes in arc length 265. The free end 264 of the band 256 may be free to extend down the inside of the interior rail 20*a*. In such a manner, the band 256 may be a mechanical barrier to prevent a user from placing fingers and the like in the pinch point area while still adjusting to compensate for the changing size of the pinch point area.

Figure 39:
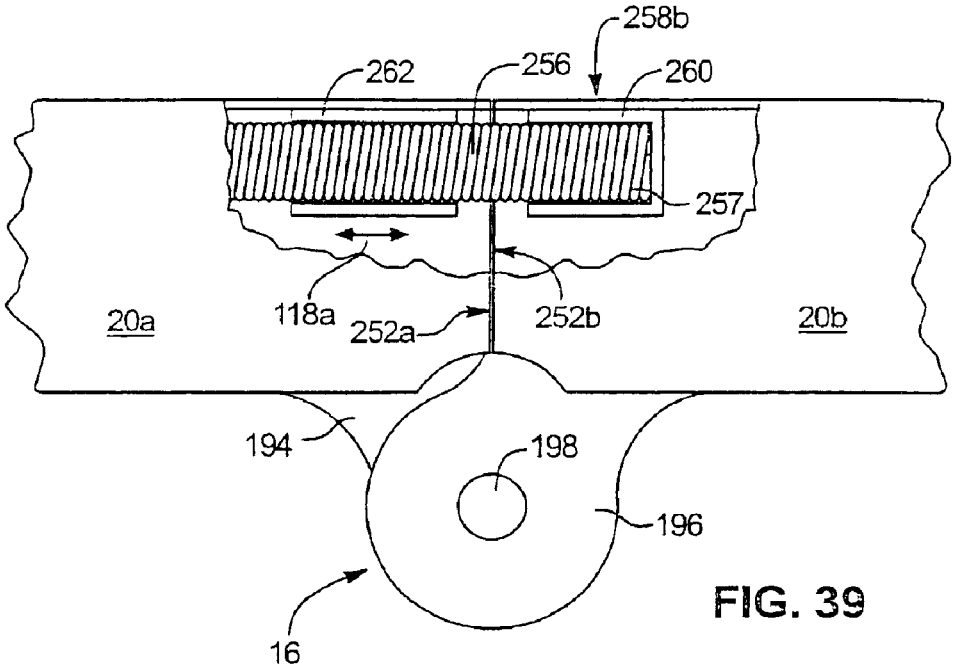
FIG. 39 is a side elevation view of a ladder hinge and rail combination in a straight position with an alternative embodiment of a pinch-point guard in accordance with the present invention.
Figure 40:
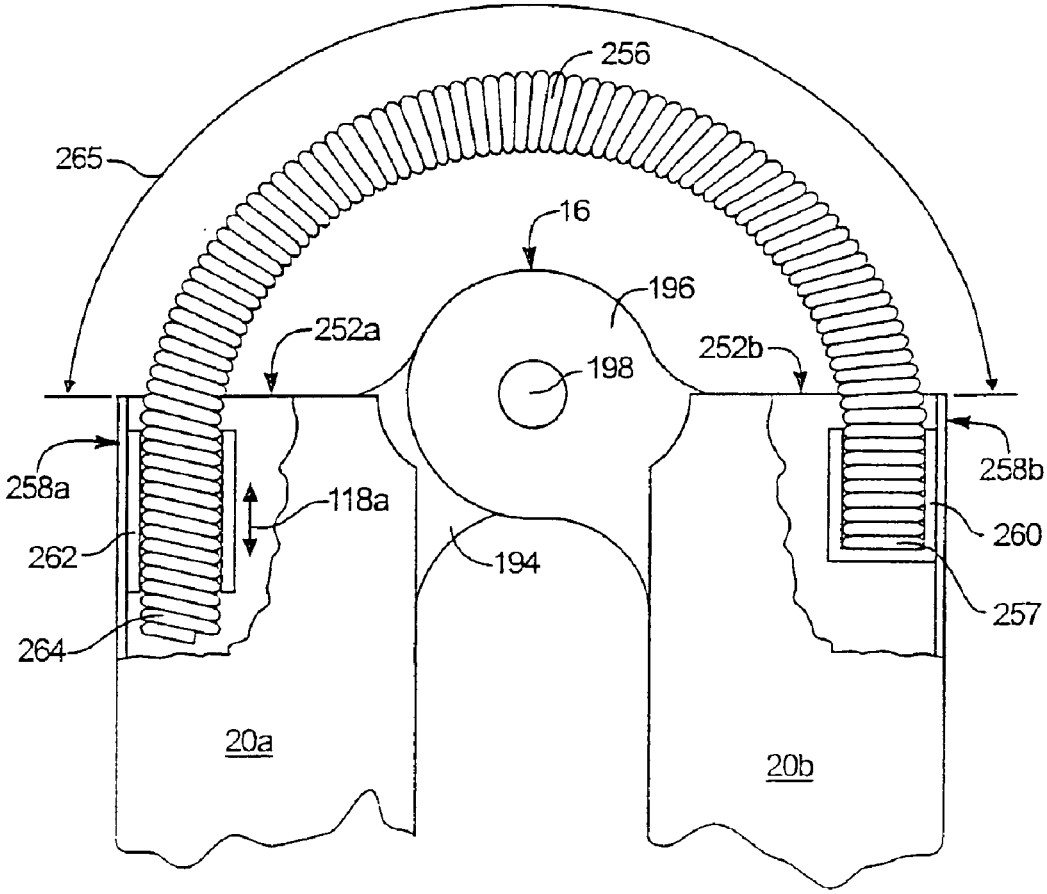
FIG. 40 is a side elevation view of the hinge and rail combination of FIG. 39 in a closed position in accordance with the present invention.

Referring to FIGS. 39 and 40, in certain embodiments, the flexible band 256 may be a densely wrapped coil spring 256. Such a spring guard 256 may operate very similarly to the band guard 256 described hereinabove. The diameter of the spring 256 may be selected to fit within the interior of the interior rails 20.

Figure 41:
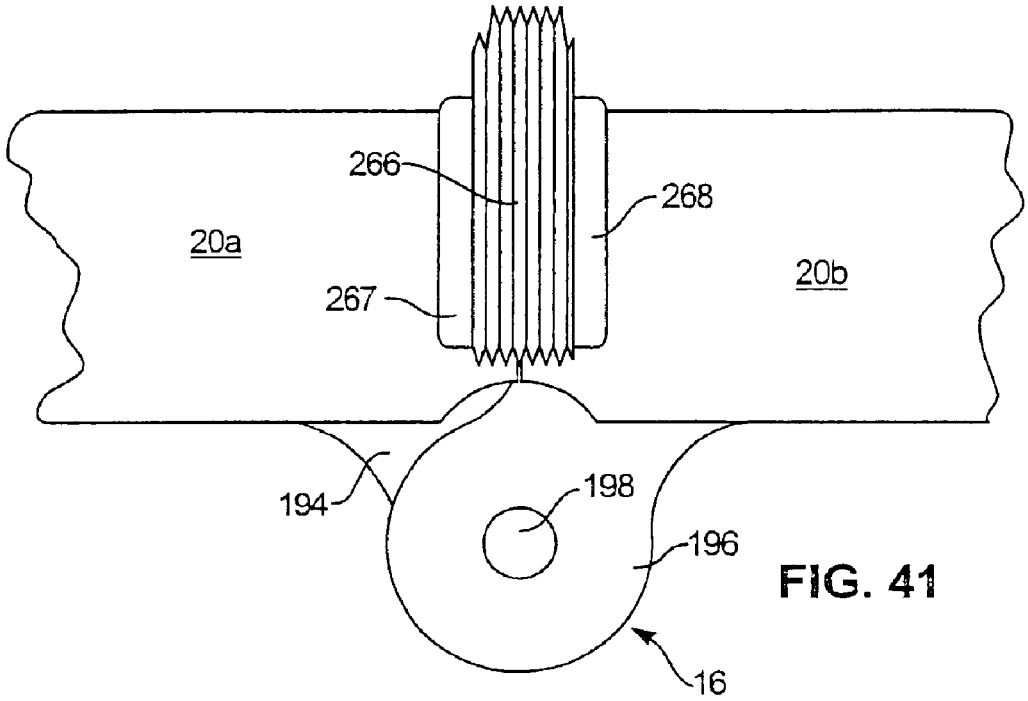
FIG. 41 is a side elevation view of a ladder hinge and rail combination in a straight position with an alternative embodiment of a pinch-point guard in accordance with the present invention.
Figure 42:
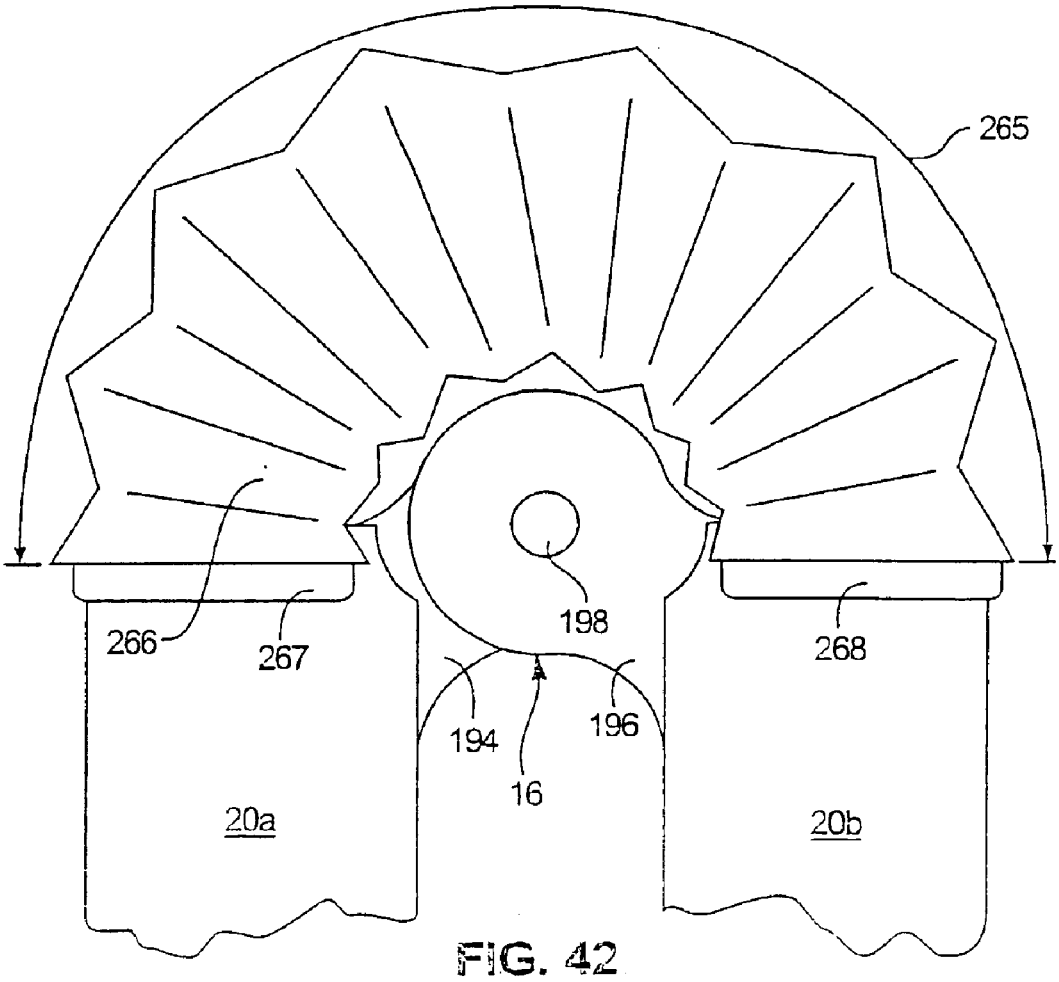
FIG. 42 is a side elevation view of the hinge and rail combination of FIG. 41 in a closed position in accordance with the present invention.

Referring to FIGS. 41 and 42, in selected embodiments, a shield 256 may be in the form of an extensible and retractable guard 266. Such a guard 266 may have a first end 267 secured to a first interior rail 20*a* and a second end 268 secured to a second interior rail 20*b*. As the hinge 16 passes through its range of motion, the guard 266 may act as an accordion and extend to cover the varying arc length 265. Such a guard 266 may be constructed of any suitable material. Possible materials may include a polymer, rubber or other elastomer, or the like.

If desired, the band 256 and spring 256 embodiments of FIGS. 37–40 may be applied to the guard 266 of FIGS. 41 and 42. That is, the band 256 or spring 256 may support the guard 266, holding it in an arced configuration spaced from the hinge 16. As the hinge 16 pivots to the straight configuration, the band 256 or spring 256 may aid the collapsible guard 266 in properly gathering without being pinched between the end faces 252*a*, 252*b*.

Figure 43:
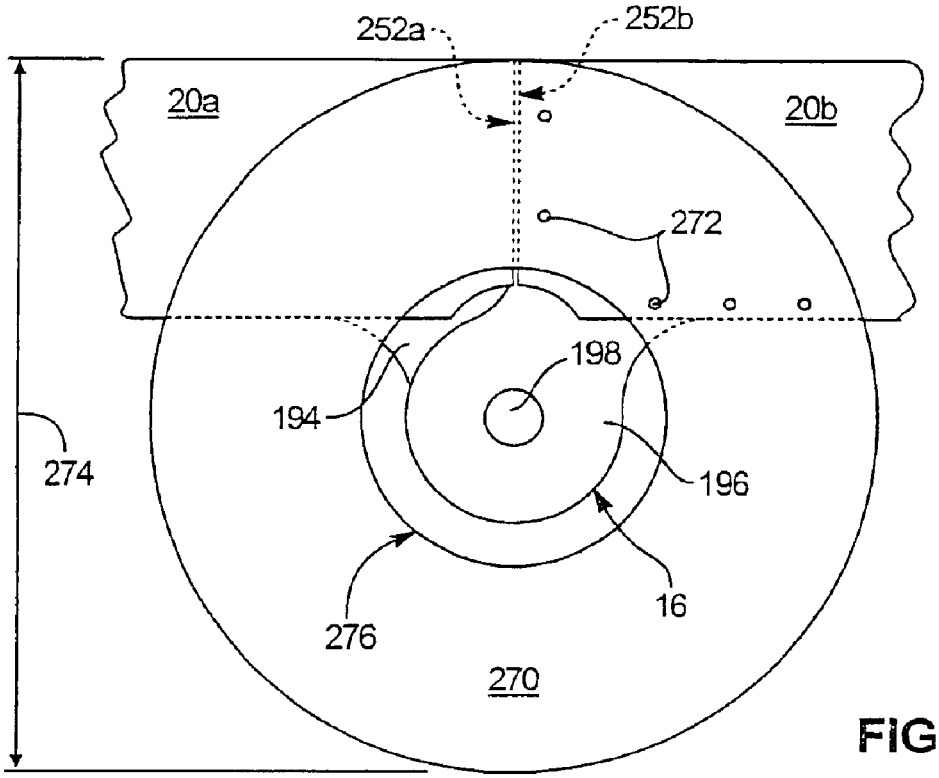
FIG. 43 is a side elevation view of a ladder hinge and rail combination in a straight position with an alternative embodiment of a pinch-point guard in accordance with the present invention.
Figure 44:
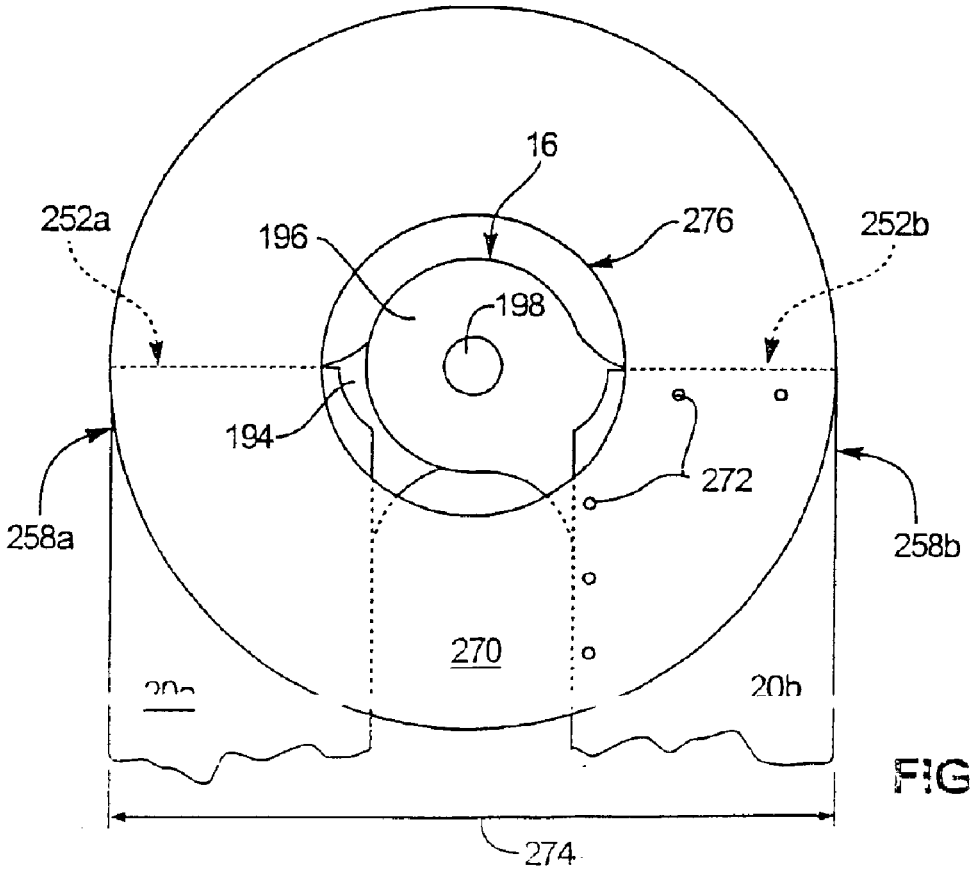
FIG. 44 is a side elevation view of the hinge and rail combination of FIG. 43 in a closed position in accordance with the present invention.

Referring to FIGS. 43 and 44, in selected embodiments, a disk-like guard 270 may be employed to prevent a user from being caught in the pinch point of a hinge 16. This guard 270 may act as a barrier to stop any part of a user from being introduced into the pinch point. In certain embodiments, the disk guard 270 may be generally circular. The guard 270 may be fixed by fasteners 272 to one of the interior rails 20*b*. In embodiments where the armatures 194, 196 include housings 238, the guard 270 may secure directly to one of the housings 238. Disk guards 270 may be constructed of any suitable material. Suitable materials may include metals, metal alloys, composites, polymers, woods, or the like.

Generally, the center of the disk guard 270 may be placed over the pivot pin 198 of the hinge 16. The diameter of the disk guard 270 may be selected to correspond to the maximum distance 274 of separation between the first outer wall 258*a* and the second outer wall 258*b*. Thus, as the hinge 16 travels through its range of motion, the guard 270 stops anything from coming between the end faces 252*a*, 252*b*. If desired, disk guards 270 may be placed on both sides of both ladder hinges 16, thus, preventing anything from entering the pinch point from either side.

In selected embodiments, an aperture 276 may be formed over the hinge 16. The aperture 276 may provide the user with access to the components of the hinge 16 such as the release knob 212, interlock 222, and the like, which are needed for effective operation of the hinge 16.

Figure 45:
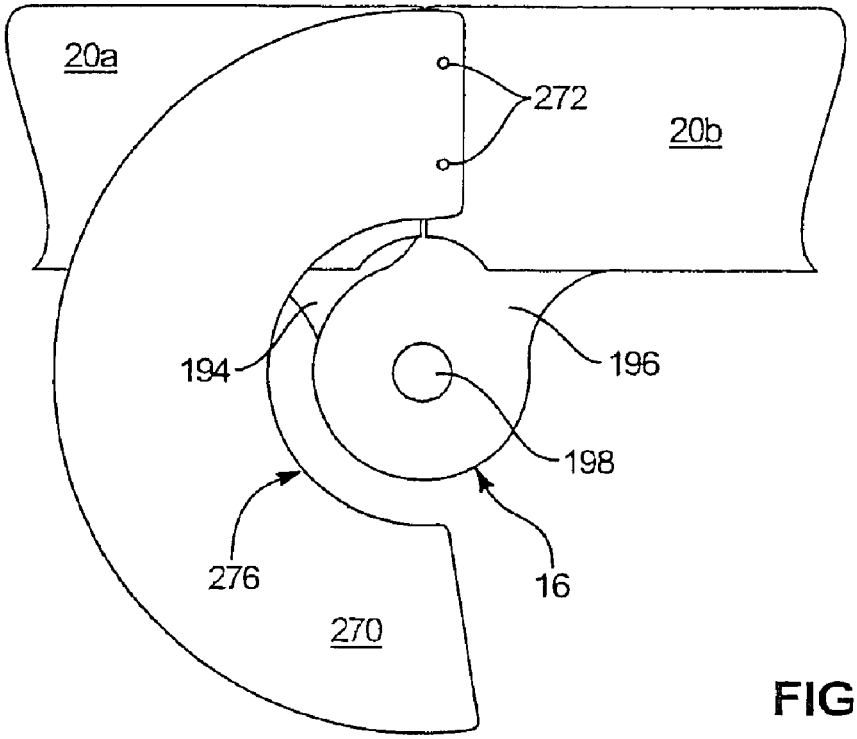
FIG. 45 is a side elevation view of a ladder hinge and rail combination in a straight position with an alternative embodiment of a pinch-point guard in accordance with the present invention.
Figure 46:
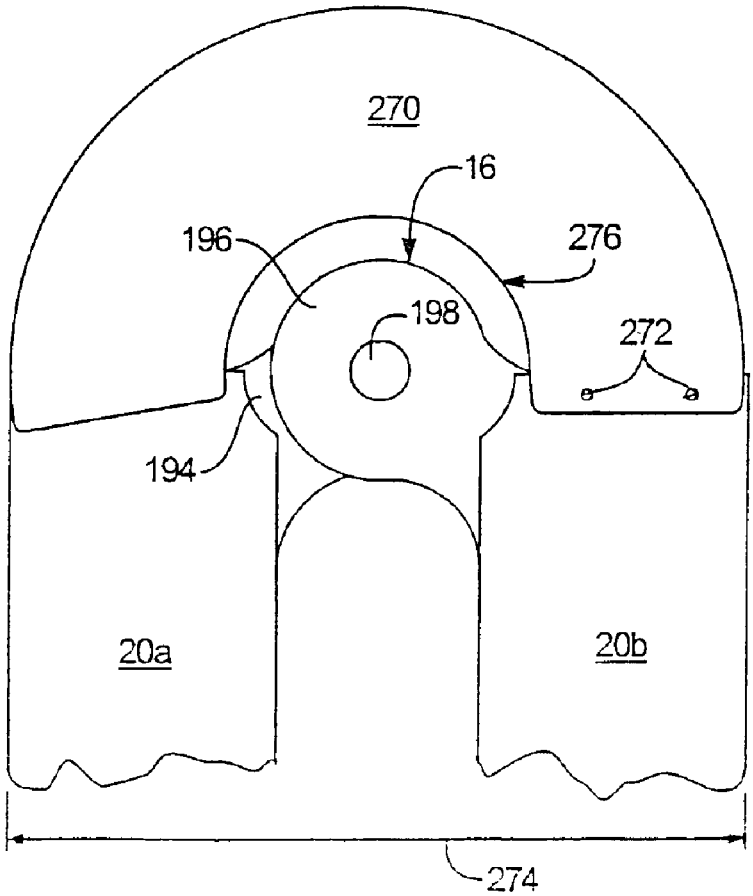
FIG. 46 is a side elevation view of the hinge and rail combination of FIG. 45 in a closed position in accordance with the present invention.

Referring to FIGS. 45 and 46, to be effective, a disk guard 270 need not extend in a complete circle around the hinge 16. In certain embodiments, the guard 270 may be a half circle. Similar to a full circle disk guard 270, a half circle disk guard 270 may be fixed by fasteners 272 to one of the interior rails 20*b*. In embodiments where the armatures 194, 196 include housings 238, the guard 270 may secure directly to one of the housings 238. A half circle disk guard 270 may also be constructed of any suitable material.

Similar to a full circle type of disk guard 270, the center of the half circle disk guard 270 may be placed over the pivot pin 198 of the hinge 16. The diameter of the half circle disk guard 270 may be selected to correspond to the maximum distance 274 of separation between the first outer wall 258*a* and the second outer wall 258*b*. Thus, as the hinge 16 travels through its range of motion, the guard 270 inhibits objects or bodily extremities from coming between the end faces 252*a*, 252*b*. If desired, disk guards 270 may be placed on both sides of both ladder hinges 16, thus, preventing anything from entering the pinch point from either side.

A notch 276 may be formed over the hinge 16. The notch 276 may provide the user with access to the components of the hinge 16 such as the release knob 212, interlock 222, and the like, which are needed for effective operation of the hinge 16.

Figure 47:
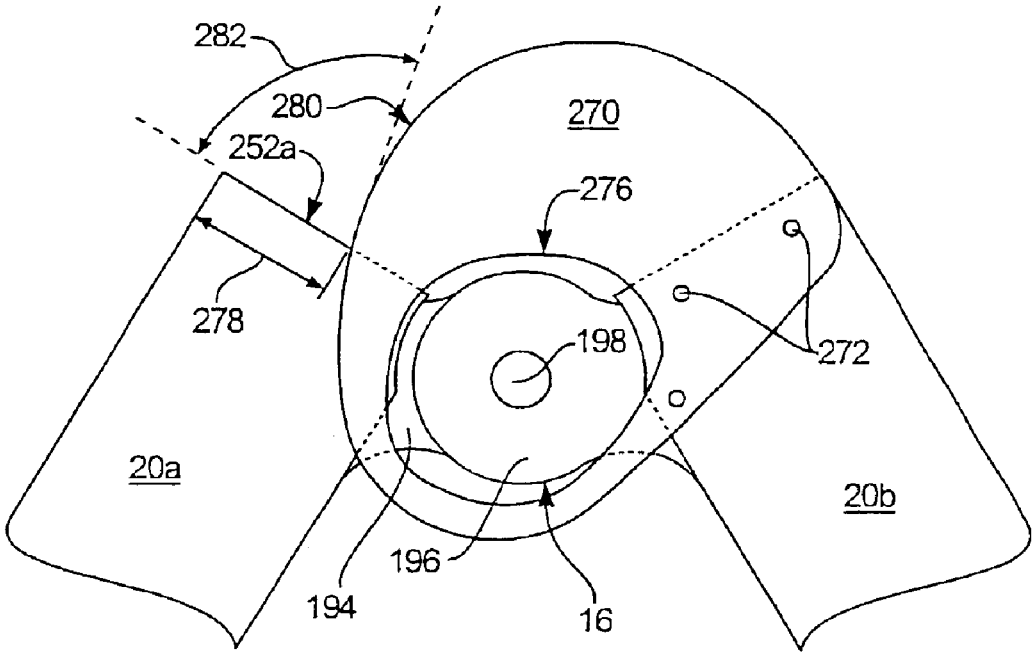
FIG. 47 is a side elevation view of a ladder hinge and rail combination in an open position with an alternative embodiment of a pinch-point guard in accordance with the present invention.
Figure 48:
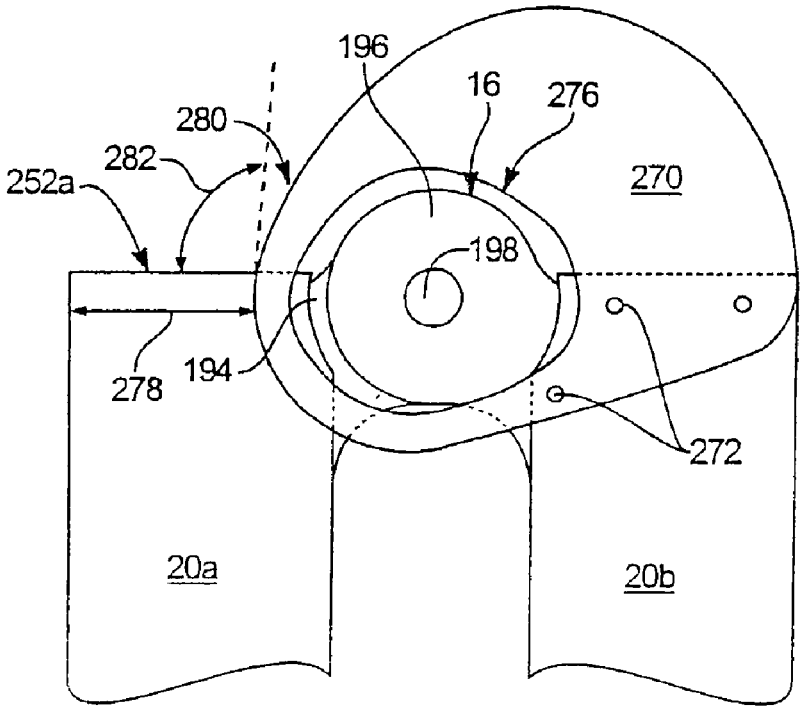
FIG. 48 is a side elevation view of the hinge and rail combination of FIG. 47 in a closed position in accordance with the present invention.

Referring to FIGS. 47 and 48, in certain embodiments, a smaller guard 270 may be advantageous. A guard 270 may be smaller than the maximum distance 274 between the outside walls 258*a*, 258*b* of the interior rails 20*a*, 20*b*. Thus, a length 278 of an end face 252*a* may be exposed when the hinge 16 is in the closed position. As the hinge 16 transitions from the closed position to the straight position, a leading edge 280 of the guard 270 may be contoured to shorten the length 278 of the exposed end face 252*a*. Thus, by the time the end faces 252*a*, 252*b* meet, the guard 270 completely covers the interface and prevents a user from being pinched.

The leading edge 280 may form an angle 282 with respect to the end face 252*a*. The angle 282 may change as the hinge 16 transitions from the closed position to the straight position. The contour of the leading edge 280 may be selected to consistently produce an acute angle 282 less than 90°. With the angle 282 less than 90°, the exposed length 278 will shorten as the hinge 16 transitions from the closed position to the straight position. Thus, the contour of the leading edge 280 and the corresponding angle 282 produced may be selected to gradually push the finger, hand, or other bodily member of the user out of the pinch point range before the hinge 16 ever reaches the straight configuration.

As discussed hereinabove, an aperture 276 may be formed over the hinge 16. The aperture 276 may provide the user with access to the components of the hinge 16 such as the release knob 212, interlock 222, and the like, which are needed for effective operation of the hinge 16.

From the above discussion, it will be appreciated that the present invention provides ladder componentry that maintains required strength while decreasing weight, is simplified to reduce manufacturing and assembly cost, and reduces the likelihood of potential hazards. The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method for manufacturing a ladder, the method comprising:

pultruding a fiber reinforced thermoplastic polymer material to form at least one rail;

cutting the at least one rail to a predetermined length;

substantially cooling and setting the thermoplastic polymer;

reheating the at least one rail to a temperature proximate a glass transition temperature corresponding to the thermoplastic polymer material and applying a force to the at least one rail in a direction substantially transverse to the at least one rail's predetermined length to form a curvature therein subsequent the reheating, the curvature including a flared portion, a straight portion, and a curved region providing a transition therebetween;

holding the at least one rail at the curvature for a time selected for the at least one rail to take on the curvature substantially permanently; and assembling the at least one rail into a ladder.

2. The method of claim 1, wherein the assembling further comprises distributing a plurality of rungs along the predetermined length of the at least one rail and coupling each of the plurality of rungs to the at least one rail.

3. The method of claim 2, further comprising forming the curved region of the at least one rail as a shape selected from the group consisting of a substantially single continuous arc substantially tangent with the flared portion, a series of angled bends spaced from one another along the curved region, and a single continuous bend connecting the straight portion to the flared portion.

4. The method of claim 3, wherein the assembling the at least one rail into a ladder further comprises inserting an extension to slide longitudinally within the straight portion of the at least one rail.

5. The method of claim 4, further comprising forming the at least one rail to exhibit a cross-sectional shape, as taken substantially transverse to the at least one rail's predetermined length, including forming the cross-sectional shape as an open shape comprising first and second retainers connected by a web.

6. The method of claim 5, further comprising providing the first and second retainers to capture the extension within, and in sliding engagement with, the straight portion.

7. The method of claim 6, further comprising configuring the first retainer to have a rib extending away therefrom and shaped to secure the plurality of rungs thereto.

8. A method for manufacturing a ladder, the method comprising:

forming a rail including:

pultruding in a longitudinal direction, the rail having a cross-sectional shape; cutting the rail to a predetermined length at a distal end;

forming the cross-sectional shape to comprising first and second retainers connected by a web;

applying a force in a direction substantially transverse to a longitudinal extend of the rail to form a nonlinear segment therein, the nonlinear segment including a flared portion, a straight portion, and a curved region providing a transition therebetween, wherein forming the curved region comprises bending the rail into a shape selected from the group consisting of a substantially single continuous arc substantially tangent with the flared portion, a series of angled bends spaced from one another along the curved region, and a single continuous bend connecting the straight portion to the flared portion; and holding the rail at a configuration of the nonlinear segment for a time sufficient for the rail to take on the configuration substantially permanently; and assembling the rail into a ladder including:

longitudinally distributing, along the flared portion and straight portion, rungs extending laterally, the flared portion being located to support the ladder on a supporting surface to increase stability thereof;

inserting an extension to slide longitudinally within the straight portion;

providing the first and second retainers to capture the extension within, and in sliding engagement with, the straight portion; and configuring the first retainer to have a rib extending away therefrom and shaped to secure the rungs thereto.

9. The method of claim 8, wherein the pultruding further comprises pultruding fiber reinforced thermoset polymer matrix.

10. The method of claim 9, further comprising curing the fiber reinforced thermoset polymer matrix.

11. The method of claim 8, wherein the pultruding further comprises pultruding a reinforced fiber in a thermoplastic polymer material.

12. The method of claim 11, further comprising substantially cooling and setting the thermoplastic polymer material.

13. The method of claim 12, further comprising reheating the at least one rail to a temperature proximate a glass transition temperature corresponding to the thermoplastic polymer material before applying the force to the at least one rail.

14. A method for manufacturing a ladder, the method comprising:

pultruding in a longitudinal direction, a rail having a cross-sectional shape, including forming the rail of a reinforced fiber in a thermoplastic polymer matrix;

cutting the rail to a predetermined length at a distal end;

selecting a time to provide for substantial cooling and setting of the thermoplastic polymer matrix;

reheating the rail to a temperature proximate a glass transition temperature corresponding to the thermoplastic polymer matrix;

applying a force in a direction substantially transverse to a longitudinal extend of the rail to form a nonlinear segment therein, the nonlinear segment including a flared portion, a straight portion, and a curved region providing a transition therebetween;

holding the rail at a configuration of the nonlinear segment for a time sufficient for the rail to take on the configuration substantially permanently; and assembling the rail into a ladder.

* * * * *